US008919062B1

(12) United States Patent
Viness et al.

(10) Patent No.: US 8,919,062 B1
(45) Date of Patent: Dec. 30, 2014

(54) EXTERIOR WALL PANEL SYSTEMS

(71) Applicants: Terry L Viness, Marietta, GA (US); Christopher M Romano, Landisville, NJ (US); Thomas E Remmele, Powder Springs, GA (US)

(72) Inventors: Terry L Viness, Marietta, GA (US); Christopher M Romano, Landisville, NJ (US); Thomas E Remmele, Powder Springs, GA (US)

(73) Assignee: STO Corp., Atlanta, GA (US)

( * ) Notice: Subject to any disclaimer, the term of this patent is extended or adjusted under 35 U.S.C. 154(b) by 0 days.

(21) Appl. No.: 13/953,130

(22) Filed: Jul. 29, 2013

(51) Int. Cl.
*E04B 1/70* (2006.01)
*E04F 13/08* (2006.01)

(52) U.S. Cl.
CPC ..... *E04F 13/0869* (2013.01)
USPC ..... 52/302.3; 52/220.5; 52/302.6

(58) Field of Classification Search
CPC ..... E04B 1/70; E04B 1/7069; E04B 1/644; E04B 9/02; E04B 1/7038; E04B 2/42; E04D 13/0477; E04D 13/0445; E04F 17/00; B32B 2607/00
USPC ..... 52/302.3, 302.1, 302.2, 302.4, 302.6, 52/220.1, 220.5, 220.7, 220.8
See application file for complete search history.

(56) References Cited

U.S. PATENT DOCUMENTS

| | | | | |
|---|---|---|---|---|
| 4,924,647 | A | 5/1990 | Drucker | |
| 5,027,572 | A * | 7/1991 | Purcell et al. | 52/309.9 |
| 5,048,254 | A | 9/1991 | Merlau | |
| 5,289,664 | A | 3/1994 | Rizza et al. | |
| 5,410,852 | A * | 5/1995 | Edgar et al. | 52/408 |
| 5,836,135 | A | 11/1998 | Hagan et al. | |
| 5,870,864 | A | 2/1999 | Snyder et al. | |
| 5,979,123 | A * | 11/1999 | Brockman | 52/101 |
| 6,105,323 | A | 8/2000 | Paulle | |
| 6,108,991 | A * | 8/2000 | Hagan et al. | 52/302.3 |
| 6,745,531 | B1 * | 6/2004 | Egan | 52/302.1 |
| 6,823,633 | B2 | 11/2004 | Ryan | |
| 6,964,136 | B2 | 11/2005 | Collins et al. | |
| 8,621,799 | B2 * | 1/2014 | Sade | 52/302.1 |
| 2004/0003558 | A1 * | 1/2004 | Collins et al. | 52/302.1 |
| 2006/0283113 | A1 * | 12/2006 | Trotter | 52/302.3 |
| 2007/0044402 | A1 * | 3/2007 | Hess | 52/302.1 |
| 2008/0016808 | A1 * | 1/2008 | Pilz | 52/302.6 |
| 2011/0277393 | A1 * | 11/2011 | Hohmann, Jr. | 52/62 |
| 2011/0296781 | A1 * | 12/2011 | McCary | 52/309.2 |

OTHER PUBLICATIONS

Dryvit Systems, Inc., Outsulation® Plus MD System® DS445 Product Data, 1998, 1 page, USA.
Dryvit Systems, Inc., Outsulation® Plus MD System® Specifications DS137, 1996, 13 pages, USA.
Dryvit Systems, Inc., Outsulation® Plus MD System® Installation Details DS110, 1998, 36 pages, USA.

* cited by examiner

*Primary Examiner* — William Gilbert
*Assistant Examiner* — Gisele Ford
(74) *Attorney, Agent, or Firm* — Thomas B. McGurk

(57) ABSTRACT

Prefabricated exterior wall panel systems that incorporate one or more drainage features are disclosed. The drainage feature can include a channel formed in the panel body in fluid communication with an interior portion of the panel body and an opening in the front face of the panel. The drainage feature also can include a wedge having a sloped surface thereon on which the channel can be aligned. The exterior wall panel systems having these drainage features can be used in the exterior cladding of buildings and other structures.

30 Claims, 18 Drawing Sheets

EXTERIOR WALL PANEL SYSTEMS

TECHNICAL FIELD

The present disclosure relates generally to prefabricated exterior wall panel systems, and more particularly, to drainage systems for prefabricated exterior wall panel systems.

BACKGROUND

In the building industry, exterior wall cladding typically is fabricated onsite during the construction of a building. Exterior wall claddings can include various combinations of features that are selected depending upon the building location, desired performance characteristics of the exterior walls, and budgeted cost for the projects.

While exterior wall cladding systems sometimes are prefabricated off site in panel systems, they typically do not contain drainage features. The lack of drainage features can be attributed in part to the reliance on factory inspection prior to shipment to ensure the integrity of the panel, as well as the fact that panel moisture failure typically is limited to the panel itself. More significantly, to date there has not existed efficient and aesthetically acceptable means to divert water from the drainage plane of an exterior wall cladding panel. Traditional onsite-constructed exterior wall cladding drainage features typically include either a starter track or some type of flashing to remove moisture from the interior of a wall. The use of a starter track in a prefabricated wall panel system is impractical because the track would direct moisture from the panel into the joint between the installed panels. The use of flashing with a prefabricated wall panel system is equally impractical due to the difficulties arising from the handling and installation of flashing, as well as the inadequate moisture removal performance that would result.

Thus, there is a need for drainage systems for exterior wall panel systems that overcome some of the limitations of the current technology. Accordingly, the present disclosure provides exterior wall panel systems that address these issues.

SUMMARY

The present disclosure encompasses exterior wall panel systems having drainage features. In one aspect of the disclosure, an exterior wall panel system is provided that comprises a panel body having a drainage feature. The panel body includes a frame, a front face, a base, a top edge, a first side edge extending between the base and the top edge, and a second side edge extending between the base and the top surface. The panel body also includes an exterior layer disposed at the front face of the panel body and an insulation layer disposed between the frame and the exterior layer. The panel body has a wedge disposed between the insulation layer and the base, wherein the wedge includes a sloped surface. The panel body also has a channel formed therein, with a portion of the channel aligned on the sloped surface of the wedge. The channel can be in fluid communication with an opening formed in the exterior layer of the panel body with the opening in the exterior layer open to the front face of the panel body. The panel body also can include a first edge wrap disposed between the insulation layer and the first side edge of the panel body, a second edge wrap disposed between the insulation layer and the second side edge of the panel body.

The exterior wall panel system of the present disclosure also can include a tube disposed in a portion of the channel. Furthermore, the first and the second edge wraps can comprise a water barrier layer. Additionally, the insulation layer of the panel body can include a bevel surface facing the sloped surface of the wedge. In another aspect of the disclosure, the channel formed in the panel body can include an interior surface having a water barrier layer formed thereon. In yet another aspect, the insulation layer can comprise a rear face having a water barrier layer formed thereon. Furthermore, the wedge can have a water barrier layer formed thereon.

In yet another aspect of the disclosure, the panel body of the exterior wall panel system can include a urethane spray foam disposed between the insulation layer and the wedge. Additionally, the panel body can comprise a sheathing layer disposed between the frame and the insulation layer, as well as an adhesive ribbon disposed between the insulation layer and the sheathing layer.

In still a further aspect, the insulation layer of the panel body of the exterior wall panel system can include a trough formed therein and wherein the trough is in fluid communication with the channel. This trough can include a water barrier layer formed thereon. Additionally, the channel formed in the panel body can be one of a plurality of channels that are in fluid communication with the front face of the panel body. The exterior layers of the wall panel system can include various finishes, including brick and stucco.

The present disclosure also encompasses an exterior wall panel system comprising a panel body that includes a frame, a front face, a base, a top edge, a first side edge extending between the base and the top edge, and a second side edge extending between the base and the top surface, an exterior layer disposed at the front face of the panel body, an insulation layer disposed between the frame and the exterior layer a first edge wrap disposed between the insulation layer and the first side edge of the panel body, a second edge wrap disposed between the insulation layer and the second side of the panel body, wherein the insulation layer comprises a front surface and a rear surface, a sloped surface disposed in the panel body, and a channel formed in the panel body, wherein a portion of the channel is aligned on the sloped, and wherein the channel is in fluid communication with the front face of the panel body and the rear face of the insulation layer. In another aspect of the disclosure, the panel body can include a tube disposed in a portion of the channel.

The present disclosure also encompasses an exterior wall panel system comprising a panel body comprising a frame, a front face, a base, a top edge, a first side edge extending between the base and the top edge, and a second side edge extending between the base and the top surface. An exterior layer can be disposed at the front face of the panel body and an insulation layer disposed between the frame and the exterior layer, wherein the insulation layer comprises a rear face. The panel body also can include a wedge disposed between the base of the panel body and the insulation layer, wherein the wedge comprises a sloped surface and a water barrier formed thereon. A plurality of channels can be formed in the panel body, wherein the plurality of channels are aligned on the sloped surface of the wedge, and wherein the plurality of channels are in fluid communication with the front face of the panel body and the rear face of the insulation layer. Furthermore, a trough formed in the insulation layer, wherein the trough is in fluid communication with the plurality of channels.

These and other aspects are set forth in greater detail below and in the drawings for which a brief description is provided as follows.

DETAILED DESCRIPTION

The present disclosure encompasses pre-fabricated exterior wall panel systems that include a drainage feature formed in the panel body thereof. Such exterior wall panel systems can be installed on the exterior of a building or other structure and provide a means for removing moisture from an interior portion of the wall on which they are installed.

As used herein, the term "wall panel system" refers to a system that includes one or more wall panel bodies, and also includes a plurality of wall panels mounted on a structure.

As used herein, the term "edge" refers to the sides of a wall panel body that extend between the front face and the rear portion of the panel body.

Figure 1B:
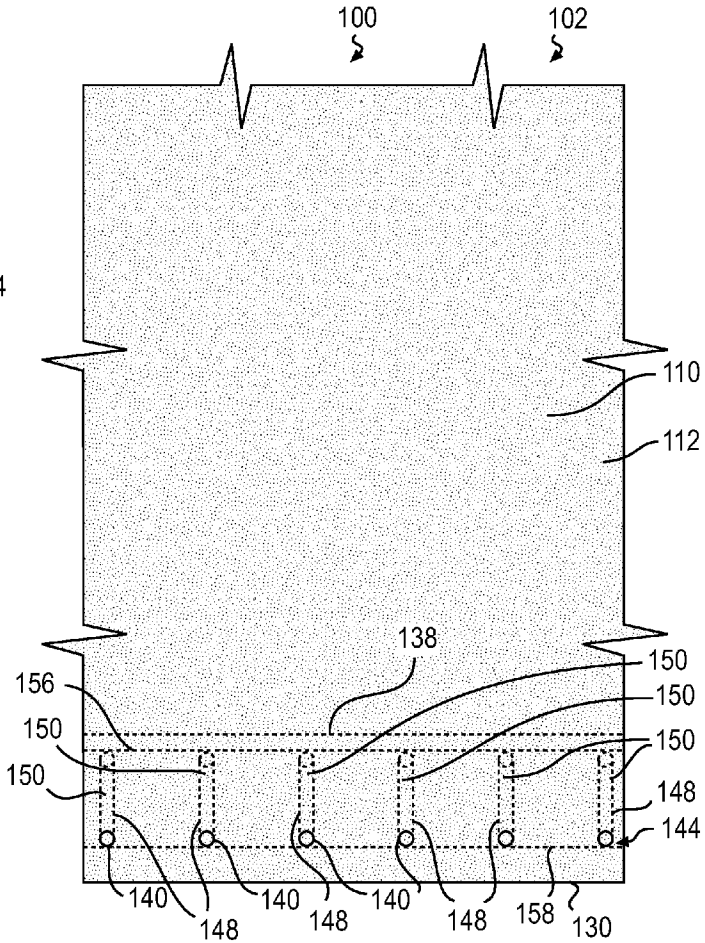
FIG. 1B is a front elevation view of a lower portion of the exterior wall panel system shown in FIG. 1A.
Figure 1A:
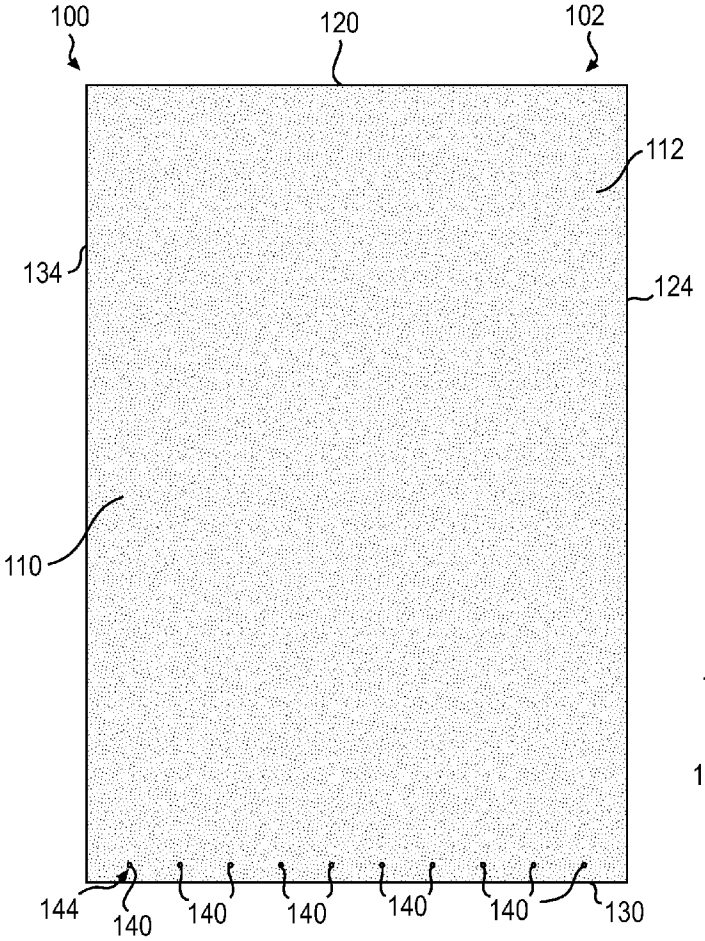
FIG. 1A is a front elevation view of an exterior wall panel system encompassing aspects of the present disclosure.

As shown in FIG. 1A, an exterior wall panel system 100 encompassing aspects of the present disclosure is shown. The exterior wall panel system 100 includes a panel body 102 having a front face 110, a top edge 120, a base 130, a first side edge 124, and a second side edge 134. A plurality of weep holes or openings 140 is formed in the exterior layer 112 and open to the front face 110 of the panel body 102. The plurality of openings 140 is disposed along the lower portion of the front face 110 of the panel body 102 so as to allow water to drain from the interior portion of the panel body 102. The plurality of openings 140 is disposed in a row 144 extending across the front face 110 of the panel body 102.

A lower portion of the body panel 102 is shown in FIG. 1B. As shown therein, the row 144 of openings 140 is formed in the exterior layer 112. Each opening 140 is aligned with a channel 150 formed in the panel body 102. The channels 150 are aligned in parallel with each other. Also shown in FIG. 1B, is the front edge 158 and rear edge 156 of a wedge disposed within the panel body 102. Each channel 150 extends from the rear edge 156 to the front edge 158 of the wedge. A trough 138 within the panel body 102 is also shown. The trough 138 can extend across the width of the panel body 102 or a portion of the width as desired.

Figure 2:
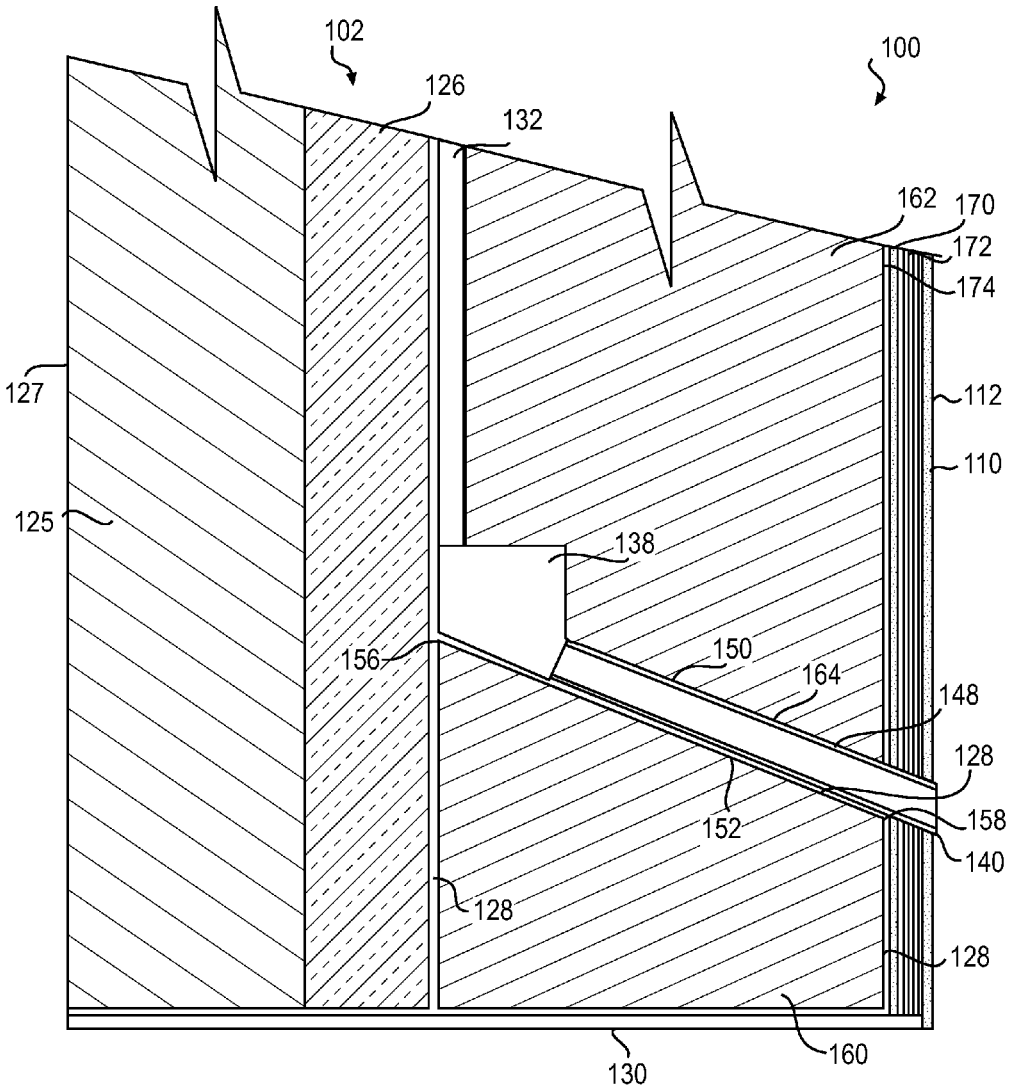
FIG. 2 is a cross-sectional view of a lower portion of the exterior wall panel system shown in FIG. 1A.

As shown in FIG. 2, the exterior wall panel system 100 includes a panel body 102 made up of a plurality of dissimilar layers. Each layer of the panel body 102 provides different performance features to the exterior wall panel system 100. The panel body 102 includes a frame 125. The frame 125 can provide support for the other layers of the panel body 102 and structure to the exterior wall panel system 100.

Figure 3:
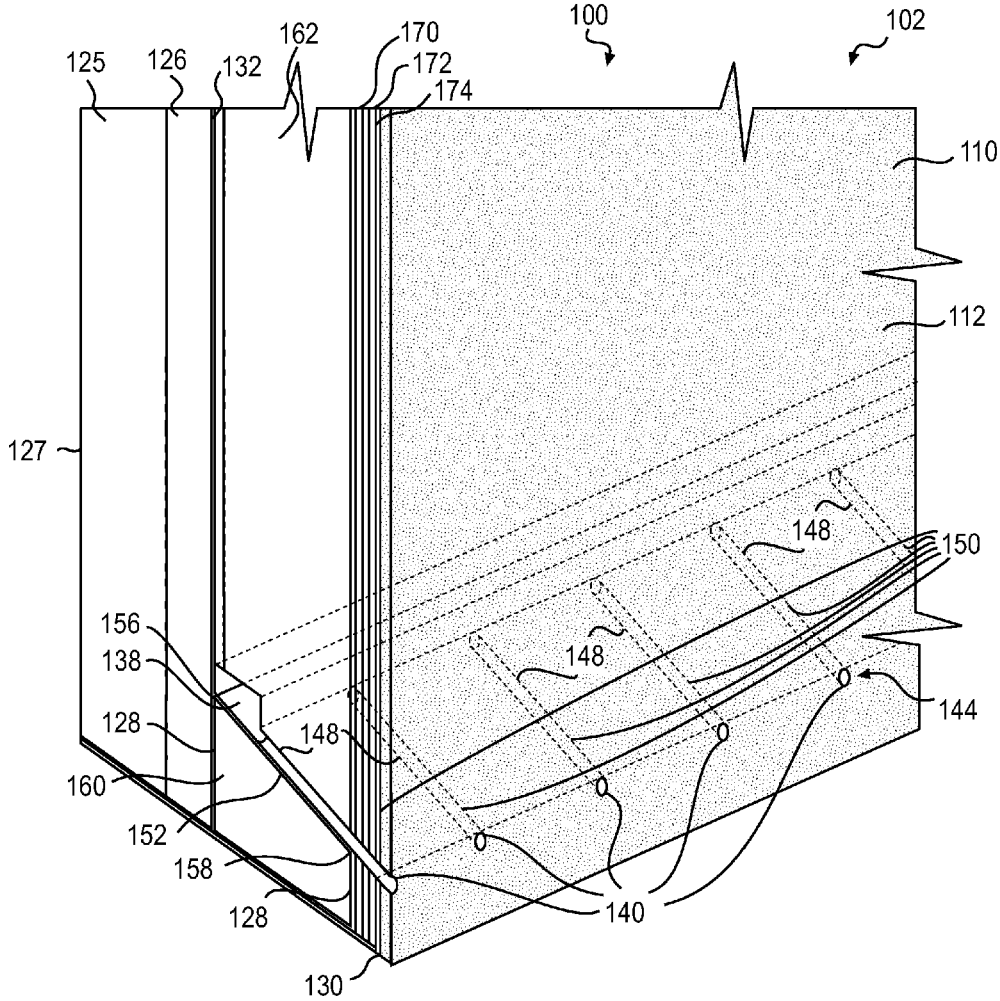
FIG. 3 is a perspective view of a lower power of the exterior wall panel system of FIG. 1A with a portion cut away and another portion shown in phantom line to show the inner structure of the panel system.
Figure 4:
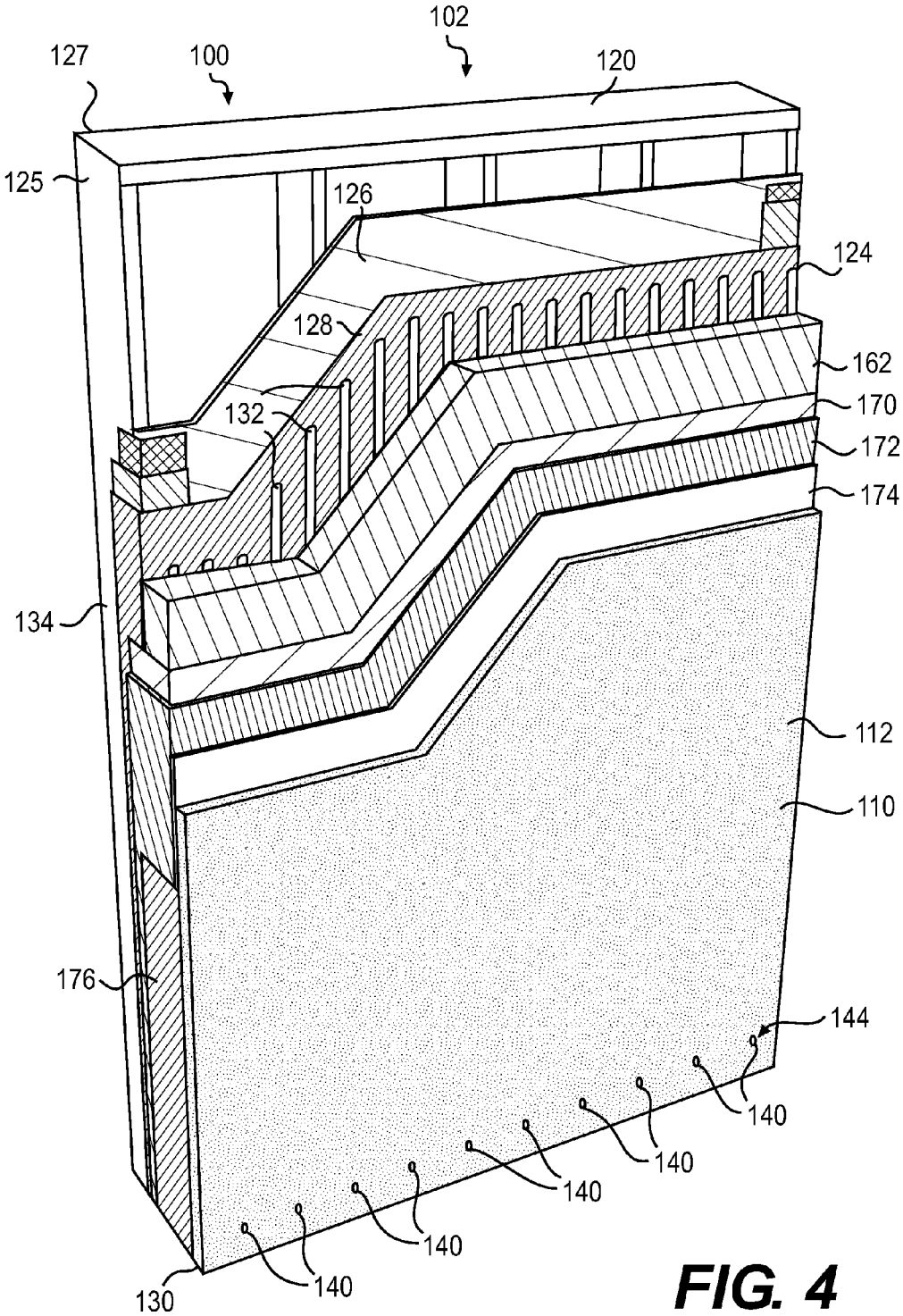
FIG. 4 is a perspective view of the exterior wall panel system of FIG. 1A with a portion cut away to show the layers of the panel body.

Attached to the frame 125 is a base layer 126. The base layer 126 can be formed of an amalgam of gypsum and glass matting. The base layer 126 provides a substrate extending across the length and width of the panel to provide a surface to which the other panel layers can be affixed. A water barrier membrane 128 is disposed on the base layer 126. The water barrier membrane 128 can be formed of a latex-based coating, such as Sto Gold Coat, manufactured by Sto Corp, or other coating providing waterproof performance characteristics. The water barrier membrane 128 can serve to prevent moisture and air penetration of the base layer 126. In the panel body 102, adhesive ribbon 132 can be applied to the base layer or water barrier layer. The adhesive ribbon can be formed of any appropriately performing adhesive and serves as a means for attaching the insulation layer 162 to the base layer 126. As shown in FIGS. 2, 3, and 4, the adhesive layer can be aligned in a generally vertical arrangement.

As shown in FIGS. 2, 3, and 4, the insulation layer 162 extends across the width of the panel body 102. The insulation layer 162 can be formed of any appropriate material, such as expanded polystyrene (EPS), having insulative properties and other desired performance characteristics. The insulation layer 162 can comprise a continuous board that is sized and shaped to fit within the panel body 102. As shown in FIGS. 2 and 3, the insulation layer 162 can include a bevel surface 164 extending across a lower portion of the board.

As shown in FIGS. 2, 3, and 4, a wedge 160 is disposed in the panel body 102 between the base 130 and the insulation layer 162. The wedge 160 includes a front edge 158 and a rear edge 156 that is elevated higher than the front edge 158. Between these edges is a sloped surface 152 on which are aligned at least a portion of each of the channels 150. The sloped surface 152 can be configured to be generally parallel to the bevel surface 164 of the insulation layer 162. The wedge 160 can extend across the width of the panel body 102. The panel body 102 can include a single wedge 160 or, alternatively, a plurality of wedges, wherein each of the plurality of wedges can provide a slope surface on which a portion of a drainage channel can be aligned. The wedge 160 can be formed of a material having insulative properties, such as EPS or other appropriate material. The wedge 160 can be of various sizes and configurations. For example, the height of the front of the wedge 160 from the bottom to the front edge 158 can be about 2.5 cm, while the rear height from the bottom of the wedge 160 to the rear edge 156 can be about 3.8 cm. Alternative heights and ratios of front to rear heights of the wedges encompassed by the present disclosure are contemplated.

As shown in FIGS. 2, 3, and 4, the wedge 160 can be encased in a water barrier membrane 128. The sloped surface 152 can have a water barrier membrane formed thereon to allow for water to be directed down the sloped surface 152 without penetrating the wedge 160. Furthermore, the insulation layer 162 can have a water barrier membrane 128 applied to one or more surfaces thereof, including a rear face and the bevel surface 164 to allow water to flow along those surfaces without penetration into the insulation layer 162. The sloped surface 152 of the wedge can be formed at various angles such as 27°, 45°, 60° or other appropriate angle to allow water to flow by gravity from an interior portion of the panel body 102 to the front face 110.

As shown in FIG. 4, each panel body 102 of the exterior wall panel system 100 can include edge wraps 176 disposed on the edges of the panel body. The edge wraps can include one or more layers that provide the desired performance characteristics. For example, the edge wrap 176 can include a joint reinforcement, a mesh substrate, and/or a water air barrier membrane. The edge wrap 176 can extend across the entire edge of the panel body 102 or a portion thereof. For example, the edge wrap 176 can extend from behind the exterior layer 112 along the second side edge 134 to the frame 125 of the panel body 102. Within a panel body 102, a first edge wrap can be disposed on a first side edge of a panel and a second edge wrap can be disposed on a second side edge of the panel. Furthermore, the edge wrapping can extend over all or a portion of the top edge 120 and/or the base 130, so as to provide a barrier with desired performance features along all the edges of the panel body 102.

As shown in FIGS. 1B, 2, 3, and 4, the panel body 102 includes one or more channels 150 formed therein. The channels 150 extend from a rear portion of the insulation layer 162 through the layers disposed between the insulation layer 162 and the front face 110 of the panel body, including a mesh layer 170, a base coat layer 172, a primer layer 174, and an exterior layer 112. Each channel 150 is in fluid communication with the front face 110 of the panel body 102 so as to allow water and moisture to move from an interior portion of the panel body 102 out of the panel body 102 through the front face 110. The channels 150 can be of various sizes. For example, the diameter of the channel 250 can be about 0.6 cm.

As shown in FIGS. 2 and 3, each channel 150 can be in fluid communication with a trough 138 formed within the panel body 102. More particularly, the trough 138 can be formed in a portion of the insulation layer 162 and partially defined by the wedge 160. The trough 138 can have a water membrane 128 disposed on the surfaces thereof to allow for water to flow there through without penetrating into the surrounding layers of the panel body 102. The trough 138 can extend across the width of the panel body 102 and can be aligned generally horizontally along a lower portion of the insulation layer 162. The trough 138 is generally aligned at an elevated position relative to the openings 140 formed in the exterior layer 112 so as to allow for water to flow by gravity from an interior portion of the panel body to the front face 110. The troughs encompassed by the present disclosure can have various configurations. For example, the height of the trough from the rear edge 156 of the wedge 160 to the bottom edge of the insulation layer 162 can be about 1.3 cm, while the depth of the trough 138 from the rear face of the insulation layer 162 to the front of the trough 138 can also be about 1.3 cm.

The trough 138 is in fluid communication with internal voids within the panel body 102 disposed between the insulation layer 162 and the base layer 126. These internal voids can be approximately the depth of the adhesive ribbon and extend across the panel between each adhesive ribbon. In the panel body 102 shown in FIGS. 1A-4, a water membrane 128 is disposed on both the base layer 126 and the rear face of the insulation layer 162, as well as the surfaces of the trough 138 and the sloped surface 152 of the wedge 160. The void spaces within the panel body are generally covered by a water barrier membrane so as to reduce absorption of moisture into the various water permeable layers of the panel body 102. Consequently, water penetrating the panel body 102 to these void spaces has a pathway through which to travel from the void spaces to the trough 138, then through the channels 150 and out of the openings 140 in the front face 110 of the panel body 102.

As can be seen in FIGS. 1A, 1B, 3, 4, the channels 150 and the openings 140 with which they are in fluid communication are spaced along the width of the panel body 102. Though the wedge 160 and its sloped surface 152 are continuous across the width of the panel body 102, the channels 150 are aligned intermittently along the width of the panel body 102. Within the spaces formed by the sloped surface 152 of the wedge 160, the bevel surface 164 of the insulation layer 162, and the channels 150, insulation material can be applied to fill these spaces. For example, spray foams having insulative properties, such as urethane-based foams, can be applied to fill these spaces and form a continuous insulative barrier interrupted only by the channels 150.

As shown in FIGS. 2 and 3, a tube 148 can be disposed within the channel 150. The tube 148 can be formed of any convenient rigid or semi-rigid material that is waterproof. The tube 148 can help to maintain the integrity of the channel 150 and provide a conduit through which water can flow from the interior of the panel body 102 to the opening 140 in the exterior layer 112.

Figure 5:
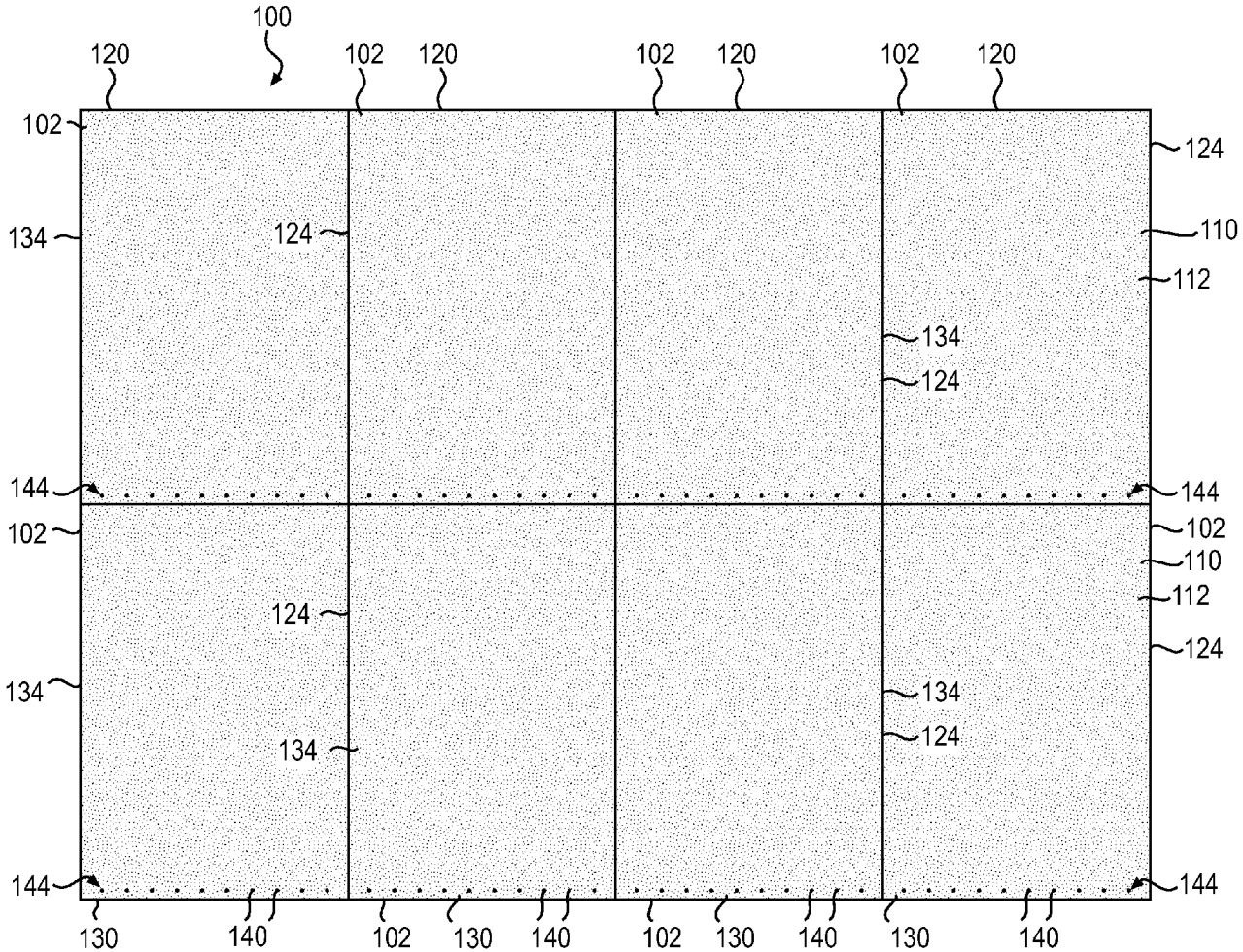
FIG. 5 is a front elevation view of the exterior wall panel system shown in FIG. 1A with a plurality of wall panels installed on a structure.

FIG. 5 shows the exterior wall panel system 100 comprising a plurality of panel bodies 102 installed on a structure. Each panel body 102 is installed with the front face 110 facing outward from the structure. The panel bodies 102 are aligned so that the first side edge 124 is aligned adjacent the second side edge 134 of the adjacent panel. Likewise, the bases 130 of the panel bodies 102 can be aligned adjacent the top edges 120 of other panel bodies installed directly below them. The panel bodies 102 within each row of panels are aligned so as to form a row of openings 140 extending across multiple panels. The panel bodies 102 can be affixed in place on the structure and then an air/water barrier calking can be applied to the seams formed between the panel bodies 102. In this way, the exterior wall panel system 100 including a plurality of panel bodies 102 can be arranged to form a generally continuous exterior surface of a building or other structure. As so installed, the exterior wall panel system 100 allows for water that penetrates the interior of the wall structure to be channeled out of the wall through the openings 140 formed in the exterior layers of each panel body 102.

Figure 6:
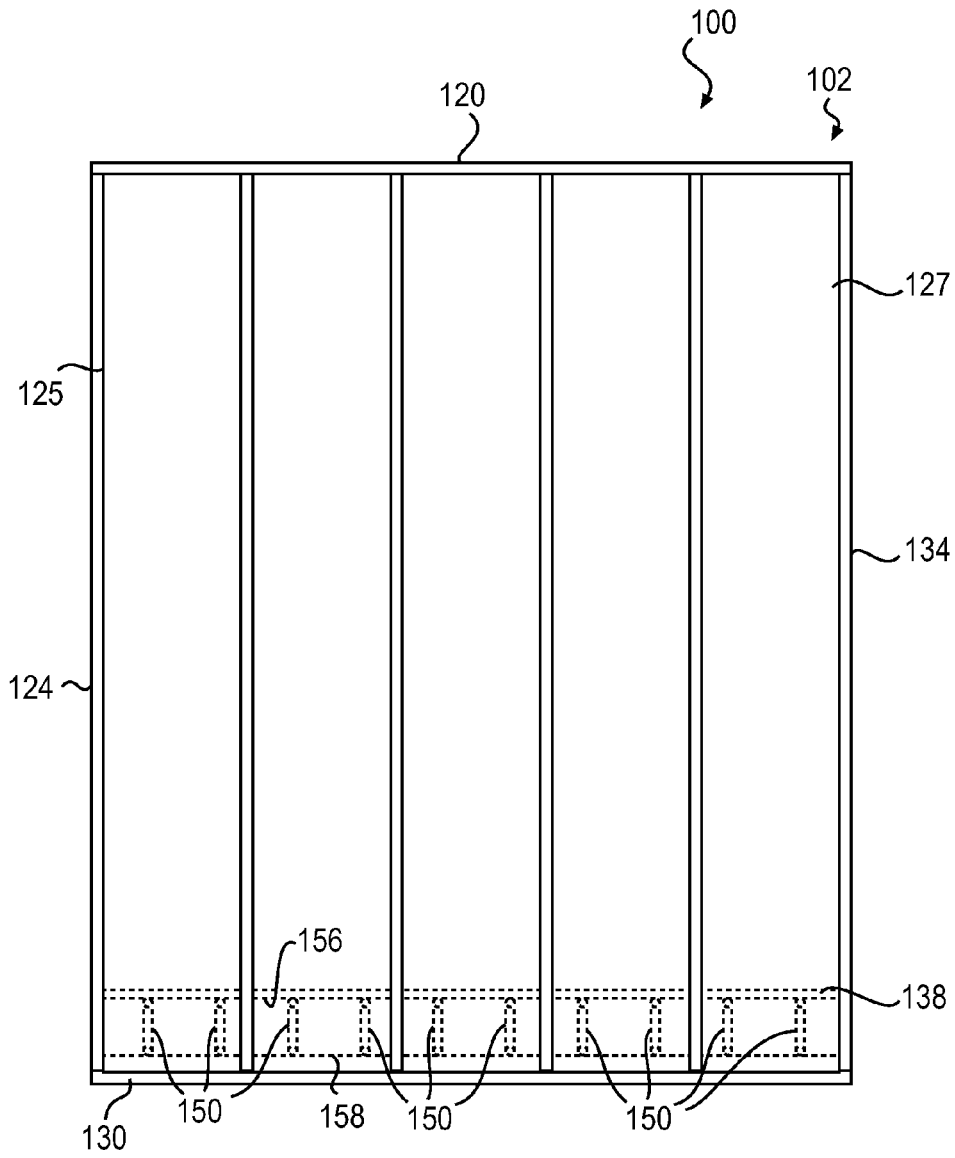
FIG. 6 is a rear elevation view of the exterior wall panel system shown in FIG. 1A with a portion of the inner structure shown in phantom line.

FIG. 6 shows the rear portion 127 of the panel body 102 of the exterior wall panel system 100 of the present disclosure. The frame 125 is aligned generally along the rear portion 127 of the panel body 102. The frame 125 includes a top beam, two side beams, a base beam, and intermediate vertical beams to provide support and reinforcement for the panel body 102. The side beams and the vertical beans extend from the base 130 to the top edge 120. The frame 125 can be made of metal, wood, or synthetic polymeric materials as needed. The alignment of the channels 150 and the trough 138 are shown in phantom line.

FIGS. 7A-12 show another embodiment of an exterior wall panel system 200 encompassing aspects of the present disclosure. The exterior wall panel system 200 includes a wall panel body 202. The wall panel body 202 comprises a front face 210, a top edge 220, a base 230, a first side edge 224, a second side edge 234, and a rear portion 227. A plurality of weep holes or openings 240 is formed in the exterior layer 212 and open to the front face 210 of the panel body 202. The plurality of openings 240 is disposed along the lower portion of the front face 210 of the panel body 202 so as to allow water to drain from the interior portion of the panel body 202. The plurality of openings 240 is disposed in a row 244 extending across the front face 210 of the panel body 202.

Figure 7B:
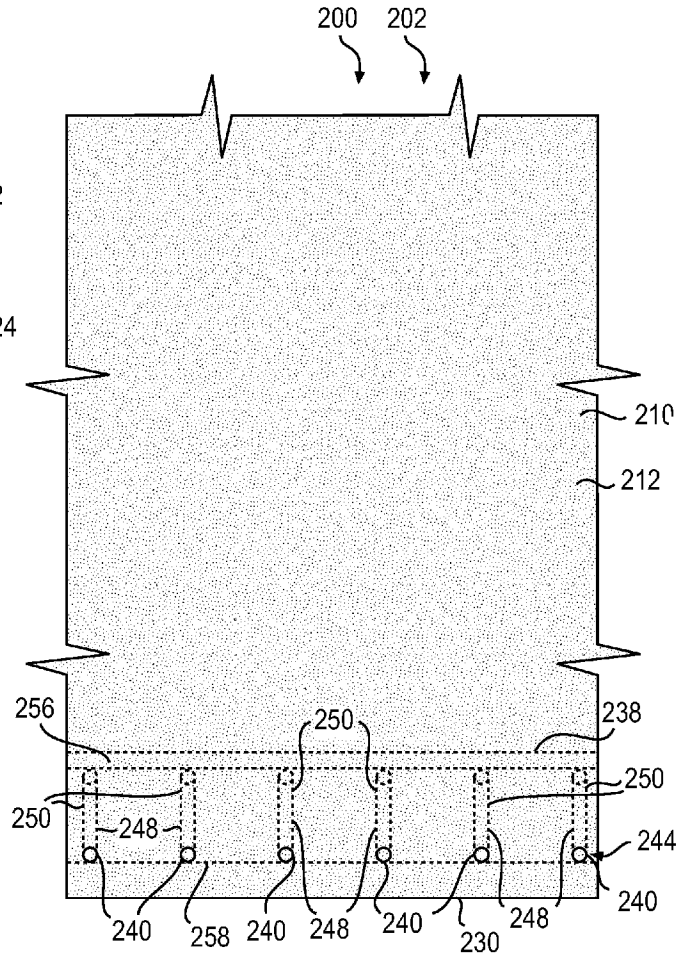
FIG. 7B is a front elevation view of a lower portion of the exterior wall panel system shown in FIG. 7A.
Figure 7A:
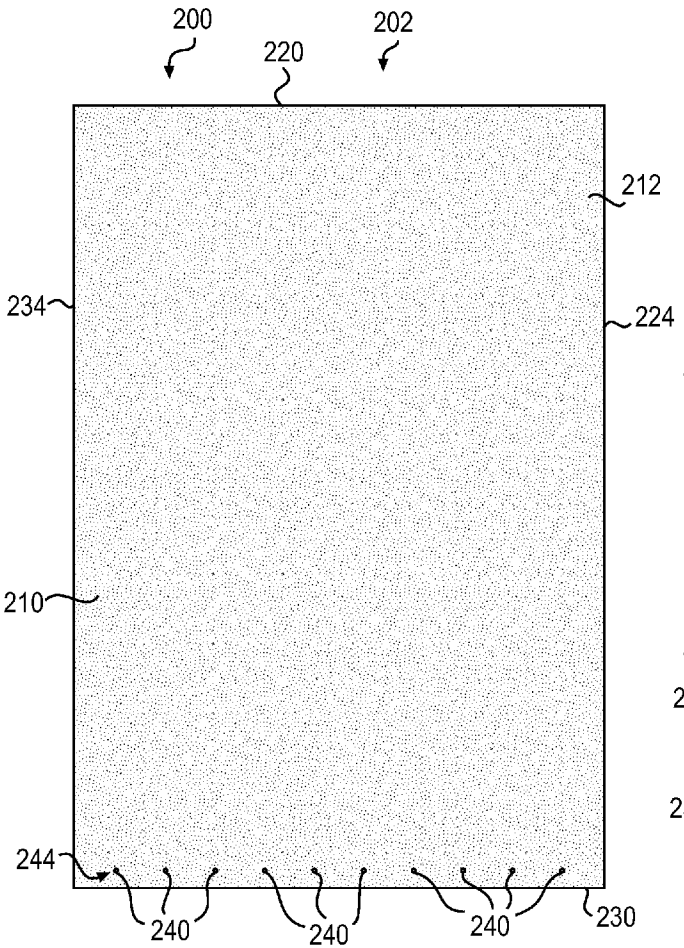
FIG. 7A is a front elevation view of another embodiment of an exterior wall panel system encompassing aspects of the present disclosure.

A lower portion of the body panel 202 is shown in FIG. 7B. As shown therein, the row 244 of openings 240 is formed in the exterior layer 212. Each opening 240 is aligned with a channel 250 formed in the panel body 202. The channels 250 are aligned in parallel with each other. Also shown in FIG. 7B, is the front edge 258 and rear edge 256 of a wedge disposed within the panel body 202. Each channel 250 extends from the rear edge 256 to the front edge 258 of the wedge. A trough 238 within the panel body 202 is also shown. The trough 238 can extend across the width of the panel body 202 or a portion of the width as desired.

Figure 8:
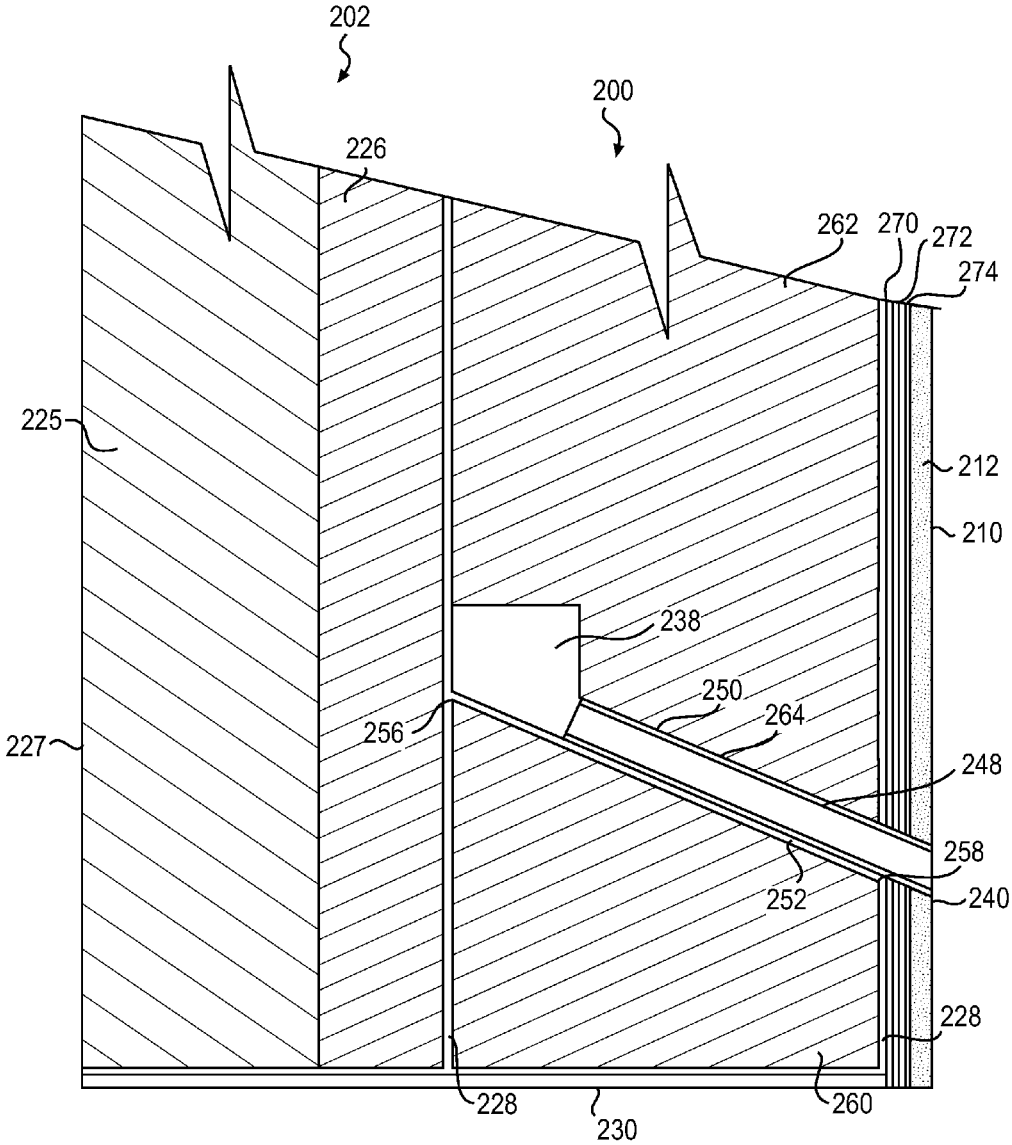
FIG. 8 is a cross-sectional view of a lower portion of the exterior wall panel system of FIG. 7A.

As shown in FIG. 8, the exterior wall panel system 200 includes a panel body 202 made up of a plurality of dissimilar layers. The panel body 202 includes a frame 225. The frame 225 provides support for the other layers of the panel body 202 and structure to the exterior wall panel system 200.

Figure 10:
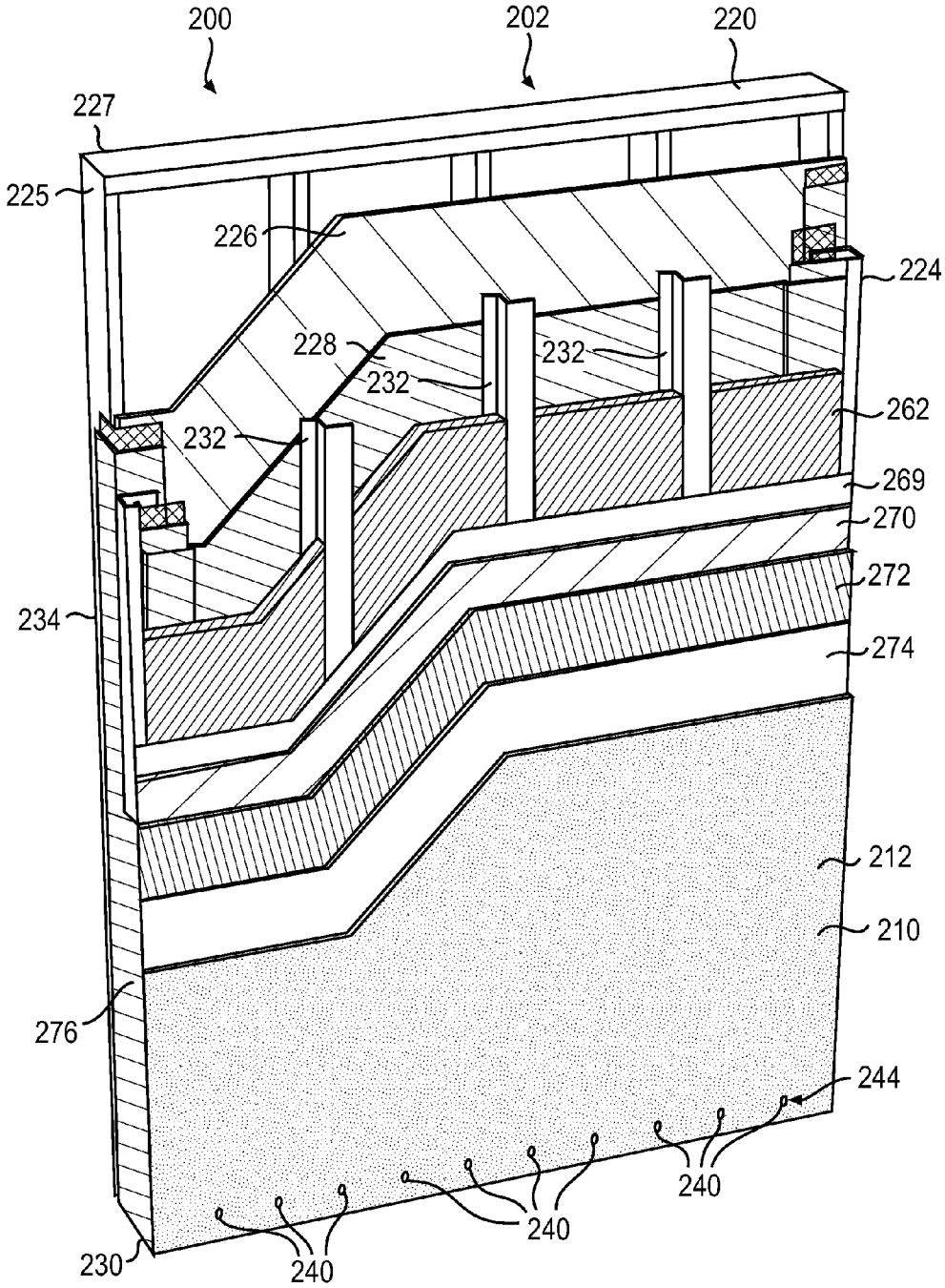
FIG. 10 is a perspective view of the exterior wall panel system of FIG. 7A with a portion cut away to show the layers of the panel body.

Attached to the frame 225 is a base layer 226. The base layer 226 can be formed of an amalgam of gypsum and glass matting or other appropriate substrate material. The base layer 226 provides a substrate extending across the length and width of the panel to provide a surface to which the other panel layers can be affixed. A water barrier membrane 228 is disposed on the base layer 226. In the panel body 202, a plurality of furrings 232 can be applied to the frame and/or base layer. The furring 232 can be formed of a metal, plastic, or other suitable material and serves as a means for attaching the insulation layer 262. As shown in FIG. 10, the furrings 232 can be aligned in a generally vertical arrangement along the width of the panel body 202 and extend from the top edge 220 to the base 230.

Figure 9:
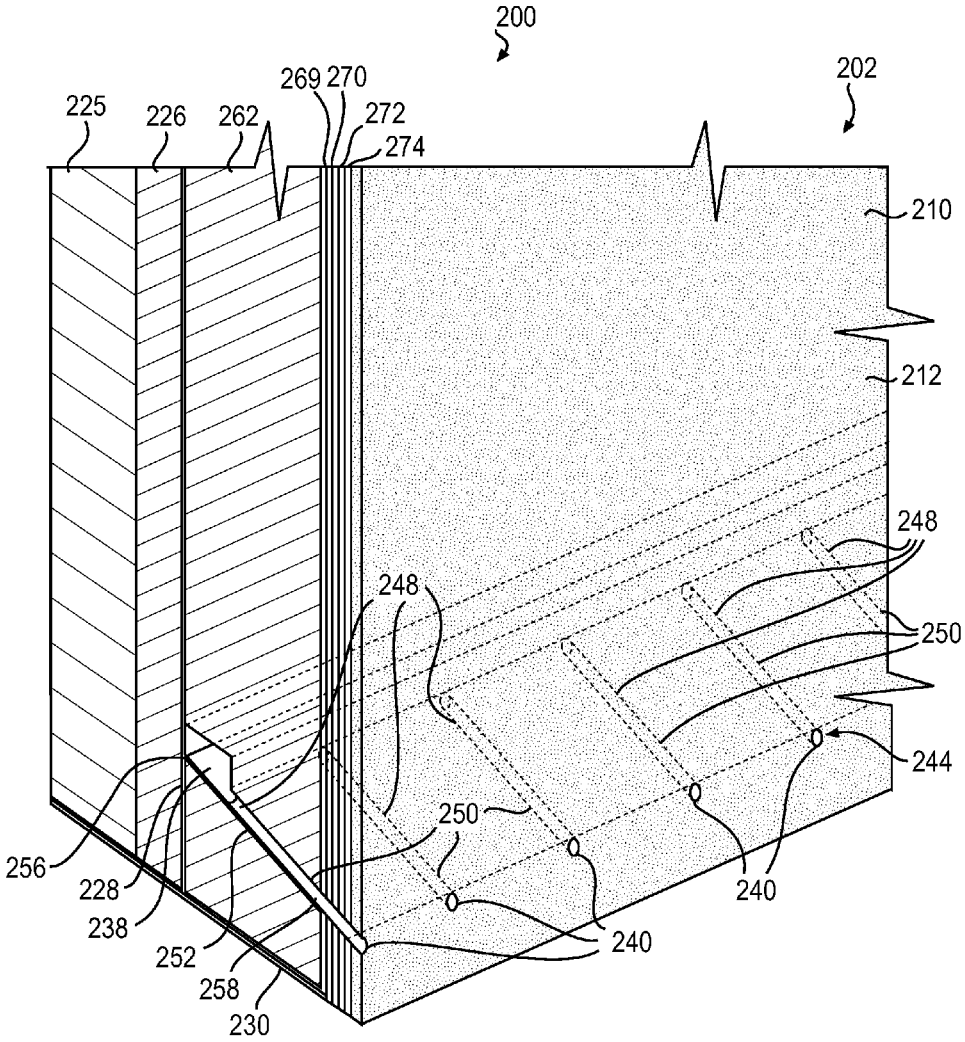
FIG. 9 is a perspective view of a lower portion of the exterior wall panel system of FIG. 7A with a portion cut away and another portion shown in phantom line to show the inner structure of the panel body.

As shown in FIGS. 8, 9, and 10, the insulation layer 262 extends across the width and length of the panel body 202. The insulation layer 262 can be formed of any appropriate material having insulative properties and other desired performance characteristics, such as expanded or extruded polystyrene board. The insulation layer 262 can comprise a continuous board that is sized and shaped to fit within the panel body 202. As shown in FIG. 8, the insulation layer 262 can include a bevel surface 264 extending across a lower portion of the board.

As shown in FIGS. 8 and 9, a wedge 260 is disposed in the panel body 202 between the base 230 and the insulation layer 262. The wedge 260 includes a front edge 258 and a rear edge 256 that is elevated higher than the front edge 258. Between these edges is a sloped surface 252 on which are aligned at least a portion of each of the channels 250. The sloped surface 252 can be configured to be generally parallel to the bevel surface 264 of the insulation layer 262. The wedge 260 can extend across the width of the panel body 202. The panel body 102 can include a single wedge 260 or alternatively a plurality of wedges can be provided within the panel body 202, wherein each of the wedges can provide a slope surface on which a portion of a drainage channel can be aligned. The wedge 260 can be formed of a material having insulative properties, such as extruded or expanded polystyrene or other appropriate material.

As shown in FIGS. 8 and 9, the wedge 260 can be encased in a water barrier membrane 228. The sloped surface 252 can have a water barrier membrane formed thereon to allow for water to be directed down the sloped surface 252 without penetrating the wedge 260. Furthermore, the insulation layer 262 can have a water barrier membrane 228 applied to one or more surfaces thereof, including a rear face and the bevel surface 264 to allow water to flow along those surfaces without penetration into the insulation layer 262.

As shown in FIG. 10, each panel body 202 of the exterior wall panel system 200 can include edge wraps 276 disposed on the edges of the panel body. The edge wraps can include one or more layers that provide the desired performance characteristics. For example, the edge wrap 276 can include a joint reinforcement, a mesh substrate, a water air barrier membrane, and/or a metal reinforcement beam. The edge wrap can extend across the entire edge of the panel body 202 or a portion thereof.

As shown in FIGS. 7B, 8, 9, and 10, the panel body 202 includes one or more channels 250 formed therein. The channels 250 extend from a rear portion of the insulation layer 262 through the layers disposed between the insulation layer 262 and the front face 210 of the panel body, including a sheeting layer 269, a mesh layer 270, a cast bed layer 272, a primer layer 274, and an exterior layer 212. The exterior layer 112 can include a suitable finish formed thereon, such as a textured stucco type finish. Each channel 250 is in fluid communication with the front face 210 of the panel body 202 so as to allow water and moisture to move from an interior portion of the panel body 202 out of the panel body 202 through the front face 210. As shown in FIGS. 8 and 9, each channel 250 can be in fluid communication with a trough 238 formed within the panel body 202. More particularly, the trough 238 can be formed in a portion of the insulation layer 262 and partially defined by the wedge 260. The trough 238 can have a water membrane 228 disposed on the surfaces thereof to allow for water to flow therethrough without penetrating into the surrounding layers of the panel body 202. The trough 238 can extend across the width of the panel body 202 and can be aligned generally horizontally along a lower portion of the insulation layer 262. The trough 238 is generally aligned at an elevated position relative to the openings 240 formed in the exterior layer 212 so as to allow for water to flow by gravity from an interior portion of the panel body to the front face 210.

The trough 238 is in fluid communication with internal spaces within the panel body 202 disposed between the insulation layer 262 and the base layer 226. These internal spaces or voids extend across the panel between each furring 232. In the panel body 202 shown in FIGS. 7A-10, a water membrane is disposed 228 is disposed between the base layer 226 and the rear face of the insulation layer 262, as well as the surfaces of the trough 238 and the sloped surface 252 of the wedge 260.

As can be seen in FIGS. 7A, 7B, 8, and 9, the channels 250 and the opening 240 with which they are in fluid communication are spaced along the width of the panel body 202. Though the wedge 260 and its sloped surface 252 are continuous across the width of the panel body 202, the channels 250 are intermittent. Within the spaces formed by the sloped surface 252 of the wedge 260, the bevel surface 264 of the insulation layer 262, and the channels 250, insulation material can be applied to fill these spaces. For example, spray foams having insulative properties, such as urethane-based foams, can be applied to fill these spaces and form a continuous insulative barrier interrupted only by the channels 250. Alternatively, sheets of insulative material can be inserted between the insulation layer 262, the wedge 260, and the channels 250 in order to provide a more continuous insulative barrier.

As shown in FIGS. 8 and 9, a tube 248 can be disposed within the channel 250. The tube 248 can be formed of any convenient rigid or semi-rigid material that is waterproof. The tube 248 can help to maintain the integrity of the channel 250 and provide a conduit through which water can flow from the interior of the panel body 202 to the opening 140 in the exterior layer 212.

Figure 11:
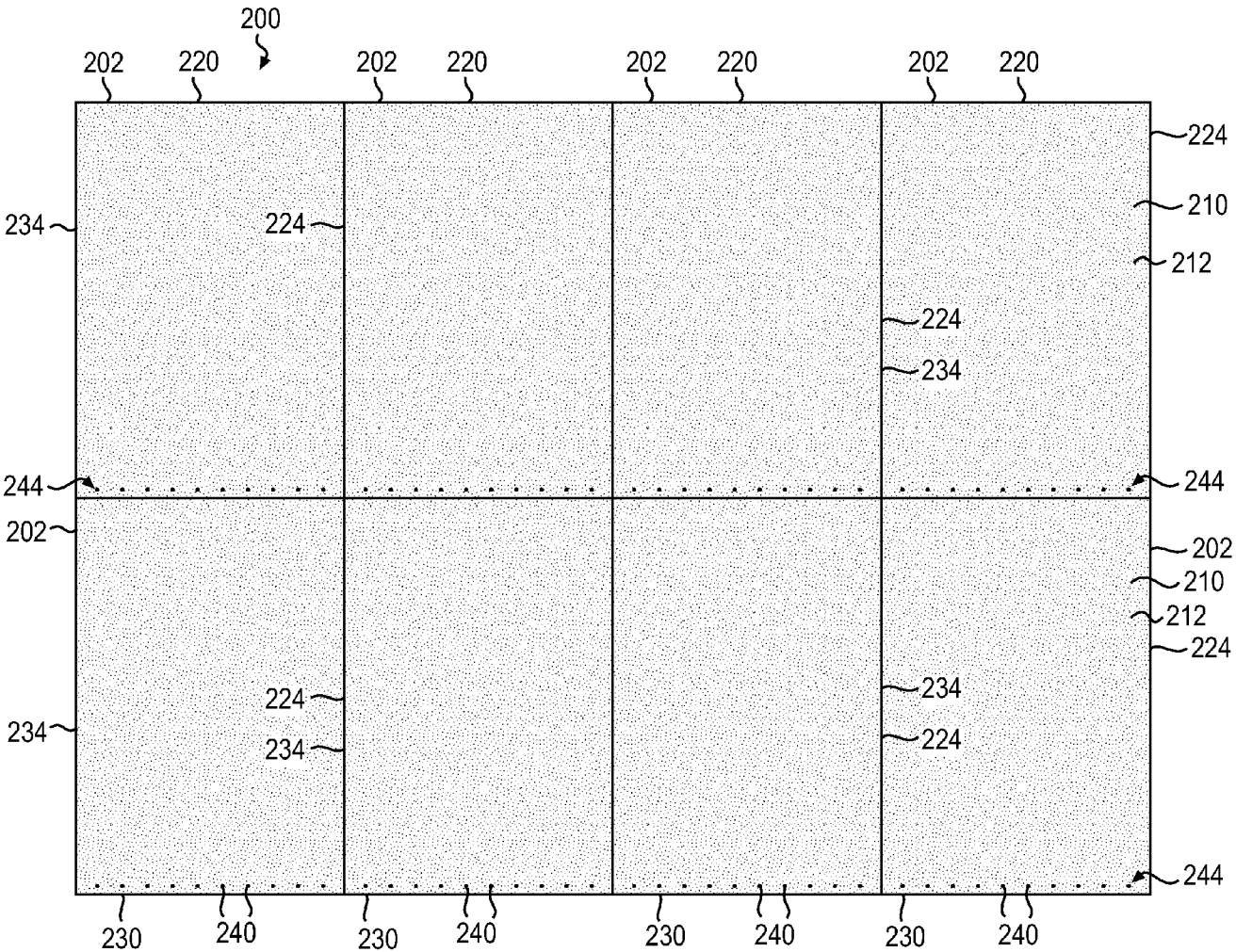
FIG. 11 is a front elevation view of the exterior wall panel system shown in FIG. 7A with a plurality of wall panels installed on a structure.

FIG. 11 shows the exterior wall panel system 200 comprising a plurality of panel bodies 202 installed on a structure. Each panel body 202 is installed with the front face 210 facing outward from the structure. The panel bodies 202 are aligned so that the first side edge 224 is aligned adjacent the second side edge 234 of the adjacent panel. Likewise, the bases 230 of some of the panel bodies 202 can be aligned adjacent the top edges 220 of the panel bodies installed directly below them. The panel bodies 202 within each row of panels are aligned so as to form a row of openings 240 extending across multiple panels. The panel bodies 202 can be affixed in place on the structure and then an air/water barrier calking can be applied to the seams formed between the panel bodies 202. In this way, the exterior wall panel system 200 including a plurality of panel bodies 202 can be arranged to form a generally continuous exterior surface of a building or other structure. As so installed, the exterior wall panel system 200 allows for water that penetrates the interior of the wall structure to be channeled out of the wall through the openings 240 formed in the exterior layers of each panel body 202.

Figure 12:
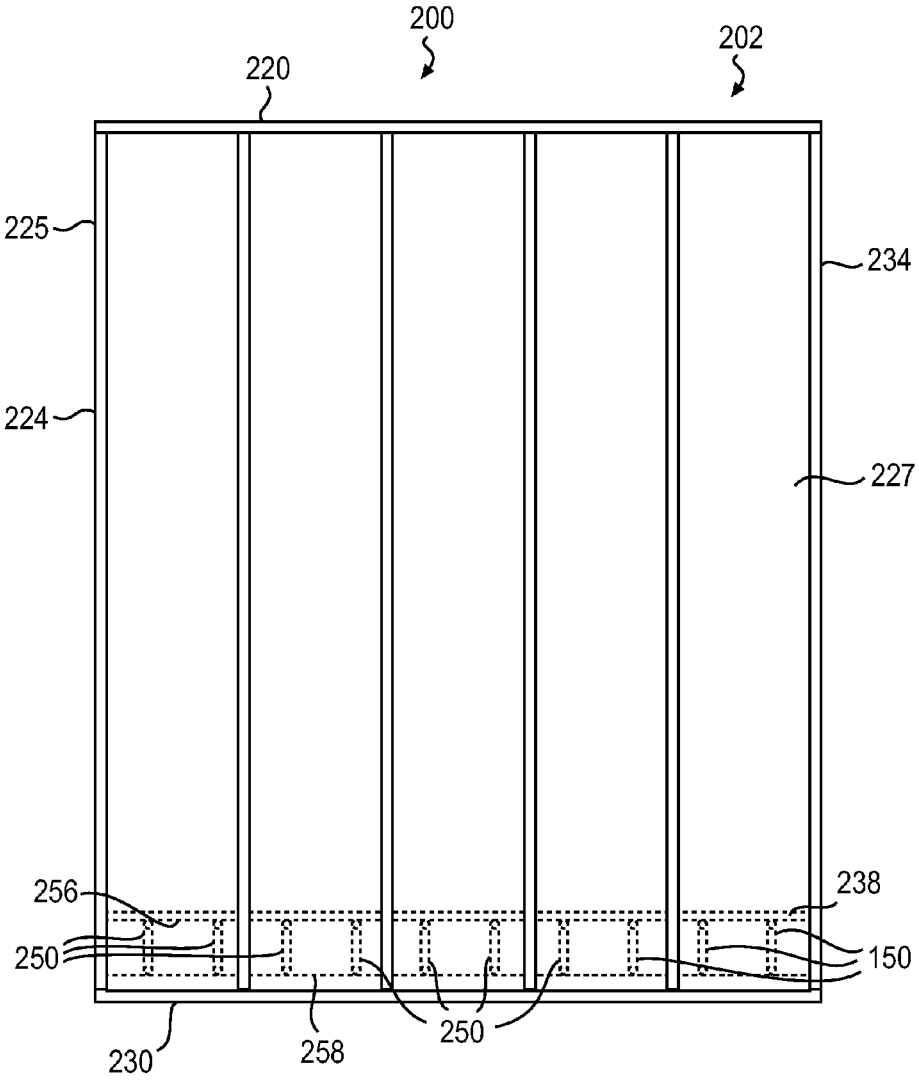
FIG. 12 is a rear elevation view of the exterior wall panel system shown in FIG. 7A with a portion of the inner structure shown in phantom line.

FIG. 12 shows the rear portion 227 of the panel body 202 of the exterior wall panel system 200 of the present disclosure. The frame 225 is aligned generally along the rear portion 227 of the panel body 202. The frame 225 includes a top beam, two side beams, a base beam, and intermediate vertical beams to provide support and reinforcement for the panel body 202. The side beams and the vertical beans extend from the base 230 to the top edge 220. The alignment of the channels 250 and the trough 238 are shown in phantom line.

FIGS. 13A-18 show another embodiment of an exterior wall panel system 300 encompassing aspects of the present disclosure. The exterior wall panel system 300 includes a wall panel body 302. The wall panel body 302 comprises a front face 310, a top edge 320, a base 330, a first side edge 324, a second side edge 334, and a rear portion 327. A plurality of weep holes or openings 340 is formed in the exterior layer 312 and open to the front face 310 of the panel body 302. The plurality of openings 340 is disposed along the lower portion of the front face 310 of the panel body 302 so as to allow water to drain from the interior portion of the panel body 302. The plurality of openings 340 is disposed in a row 344 extending across the front face 310 of the panel body 302. Alternatively, multiple rows 344 of openings 340 could be provided across the front face 310 of the panel body 302 if additional drainage capacity is necessary due to the size of the panel body 302 or the conditions at the site of installation.

Figure 13B:
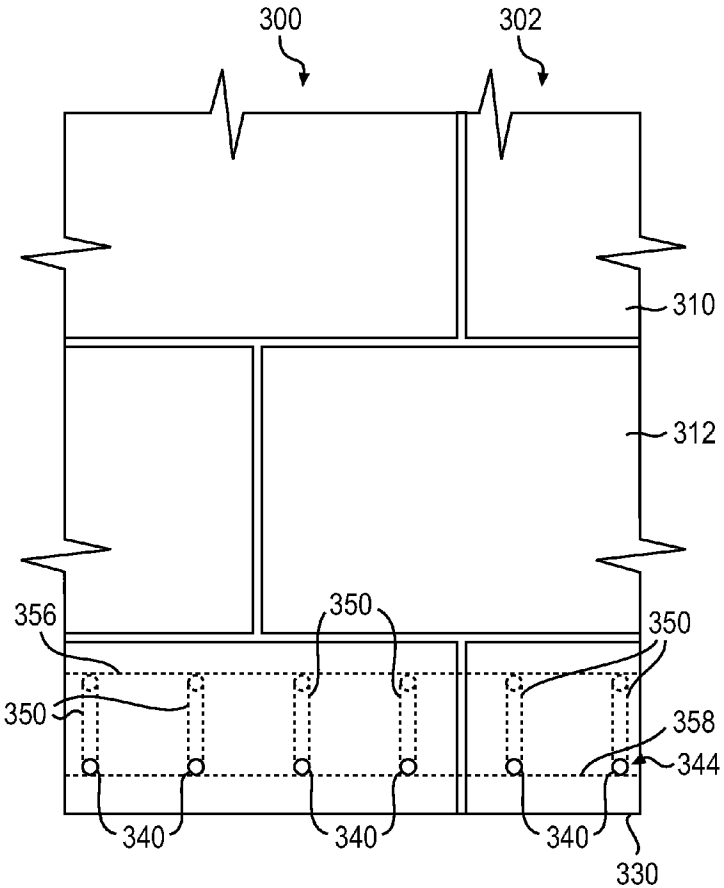
FIG. 13B is a front elevation view of a lower portion of the exterior wall panel system shown in FIG. 13A.
Figure 13A:
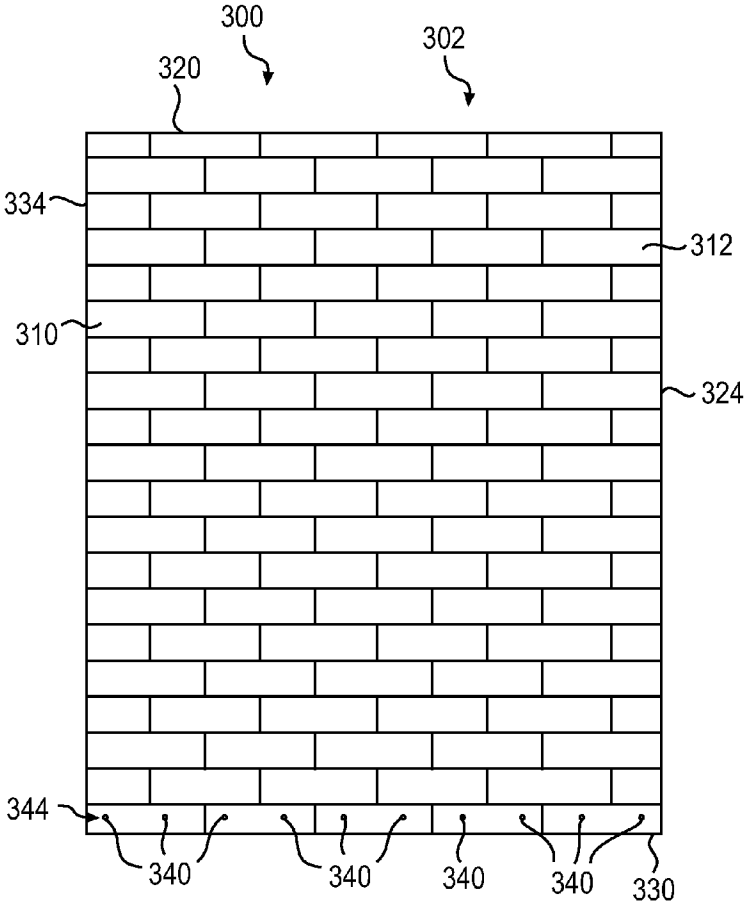
FIG. 13A is a front elevation view of another embodiment of an exterior wall panel system encompassing aspects of the present disclosure.

A lower portion of the body panel 302 is shown in FIG. 13B. As shown therein, the row 344 of openings 340 is formed in the exterior layer 312. Each opening 340 is aligned with a channel 350 formed in the panel body 302. The channels 350 are aligned in parallel with each other. Also shown in FIG. 13B, is the front edge 358 and rear edge 356 of a wedge disposed within the panel body 302. Each channel 350 extends from the rear edge 356 to the front edge 358 of the wedge.

Figure 14:
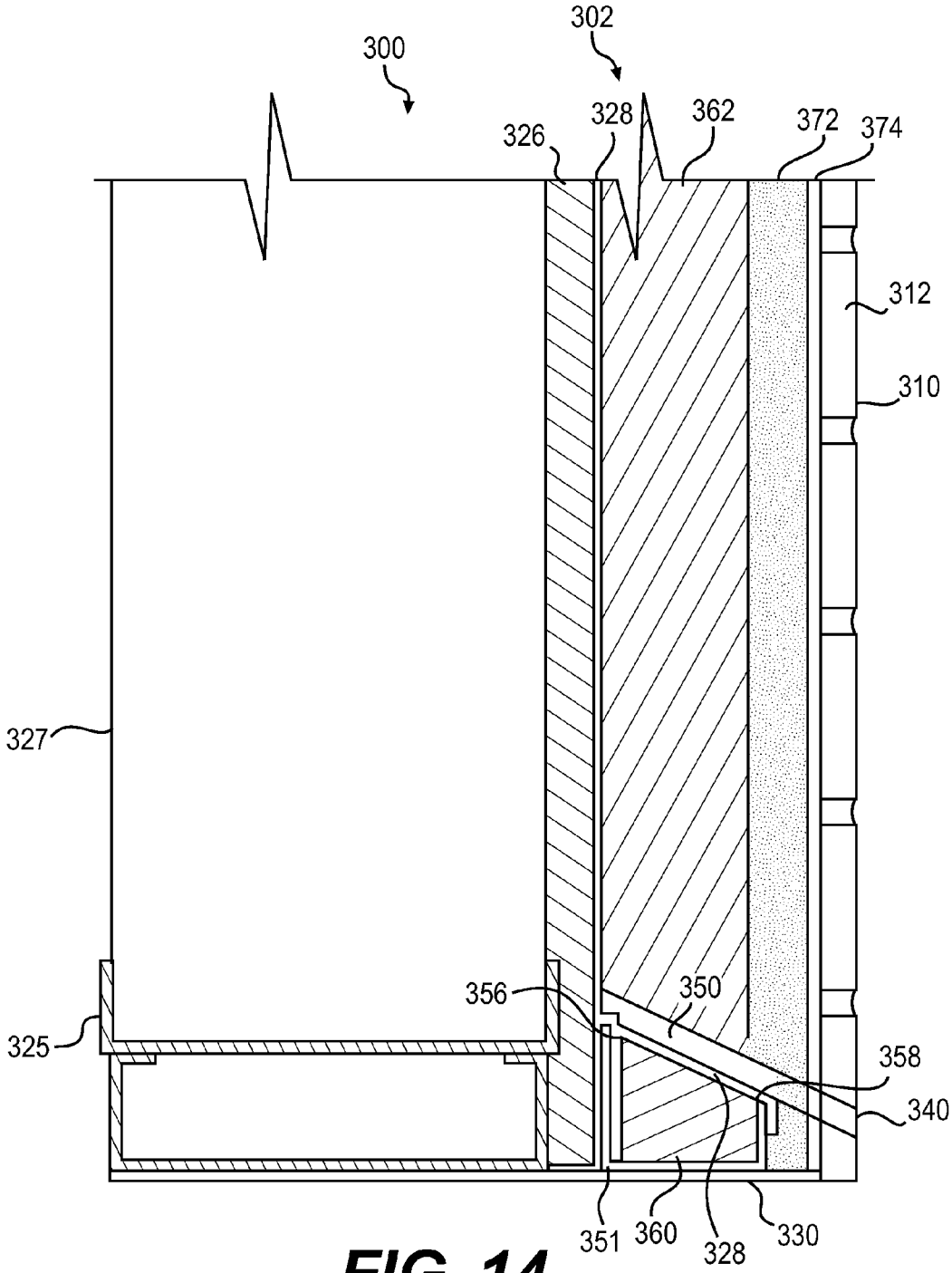
FIG. 14 is a cross-sectional view of a lower portion of the exterior wall panel system of FIG. 13A.
Figure 15:
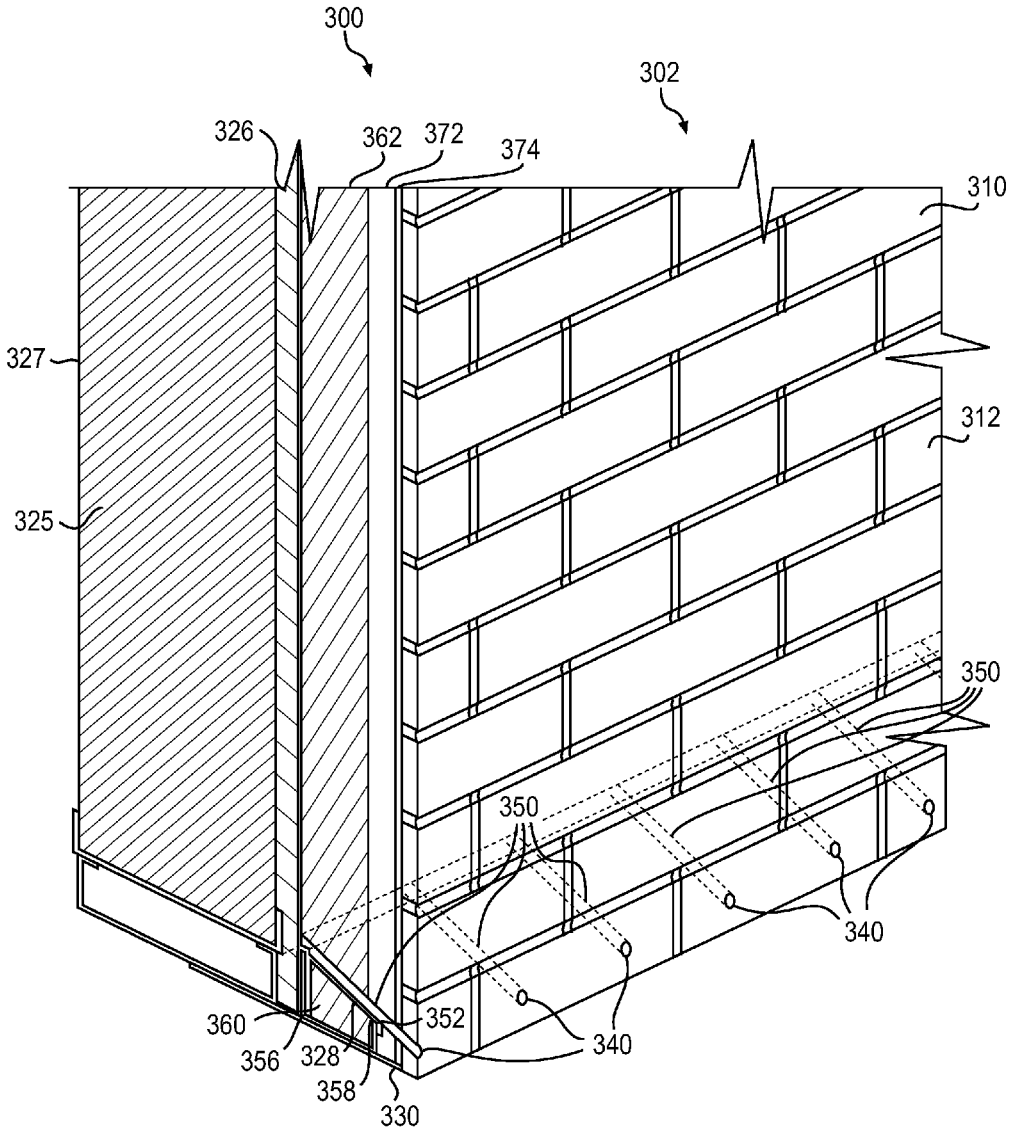
FIG. 15 is a perspective view of a lower portion of the exterior wall panel system of FIG. 13A with a portion cut away and another portion shown in phantom line to show the inner structure of the panel body.
Figure 16:
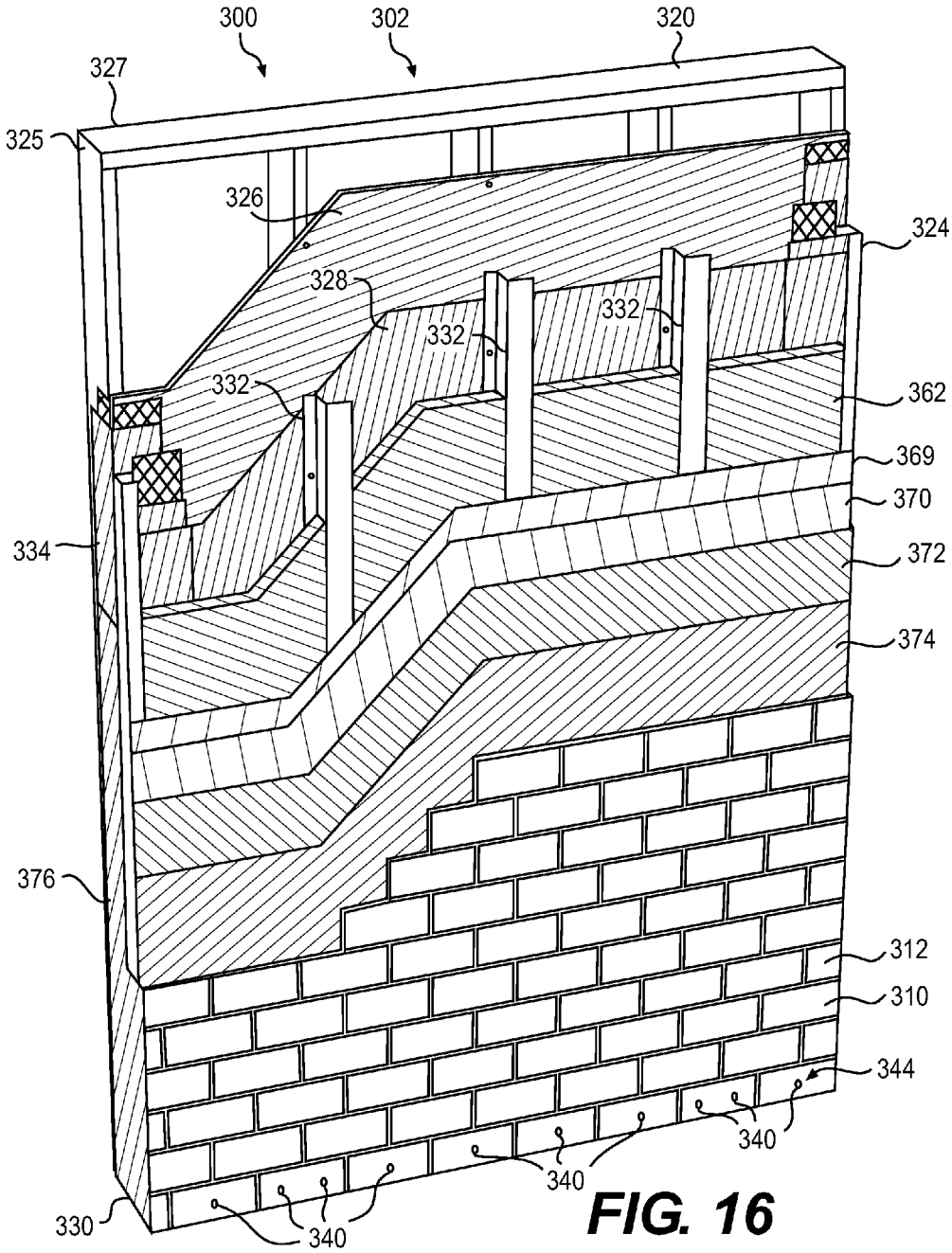
FIG. 16 is a perspective view of the exterior wall panel system of FIG. 13A with a portion cut away to show the layers of the panel body.

As shown in FIGS. 14, 15 and 16, the exterior wall panel system 300 includes a panel body 302 made up of a plurality of dissimilar layers. The panel body 302 includes a frame 325. The frame 325 provides support for the other layers of the panel body 302 and structure to the exterior wall panel system 300.

Attached to the frame 325 is a base layer 326. The base layer 326 can be formed of an amalgam of gypsum and glass matting or other appropriate substrate material. A water barrier membrane 328 is disposed on the base layer 326. In the panel body 302, a plurality of furrings 332 can be applied to the frame and/or base layer. The furring 332 can be formed of a metal or plastic and serves as a means for attaching the insulation layer 262. As shown in FIG. 16, the furrings 332 can be aligned in a generally vertical arrangement along the width of the panel body 302 and extend from the top edge 320 to the base 330.

As shown in FIGS. 14, 15, and 16, the insulation layer 362 extends across the width and length of the panel body 302. The insulation layer 362 can comprise a continuous board that is sized and shaped to fit within the panel body 302.

As shown in FIGS. 14 and 15, a wedge 360 is disposed in the panel body 302 between the base 330 and the insulation layer 362. The wedge 360 includes a front edge 358 and a rear edge 356 that is elevated higher than the front edge 358. Between these edges is a sloped surface 352 on which are aligned at least a portion of each of the channels 350. The wedge 360 can extend across the width of the panel body 302. The panel body 302 can include a single wedge 360 or alternatively a plurality of wedges can be provided within the panel body 302, wherein each of the wedges can provide a slope surface on which a portion of a drainage channel can be aligned. The wedge 360 can be formed of a material having insulative and/or structural properties.

As shown in FIGS. 14 and 15, the wedge 360 can be encased or partially covered with a water barrier membrane 328. The wedge 360 is seated in a rigid perimeter channel 351, which can be made of metal or similarly rigid material and provide added support and structure to the wedge 360. The sloped surface 352 can have a water barrier membrane formed thereon to allow for water to be directed down the sloped surface 352 without penetrating the wedge 360. Furthermore, the insulation layer 362 can have a water barrier membrane 328 applied to one or more surfaces thereof, including a rear face to allow water to flow along those surfaces without penetration into the insulation layer 362.

As shown in FIG. 16, each panel body 302 of the exterior wall panel system 300 can include edge wraps 376 disposed on the edges of the panel body. The edge wraps can include one or more layers that provide the desired performance characteristics. For example, the edge wrap 376 can include a joint reinforcement, a mesh substrate, a water air barrier membrane, and/or a metal reinforcement beam. The edge wrap can extend across the entire edge of the panel body 202 or a portion thereof.

As shown in FIGS. 13B, 14, 15, and 16, the panel body 302 includes one or more channels 350 formed therein. The channels 350 extend from a rear portion of the insulation layer 362 through the layers disposed between the insulation layer 362 and the front face 310 of the panel body, including a sheeting layer 369, a mesh layer 370, a cast bed reinforced layer 372, an adhesive layer 374, and an exterior layer 312. The exterior layer 312 can include a brick finish formed thereon. Each channel 350 is in fluid communication with the front face 310 of the panel body 302 so as to allow water and moisture to move from an interior portion of the panel body 302 out of the panel body 302 through the front face 310.

Figure 17:
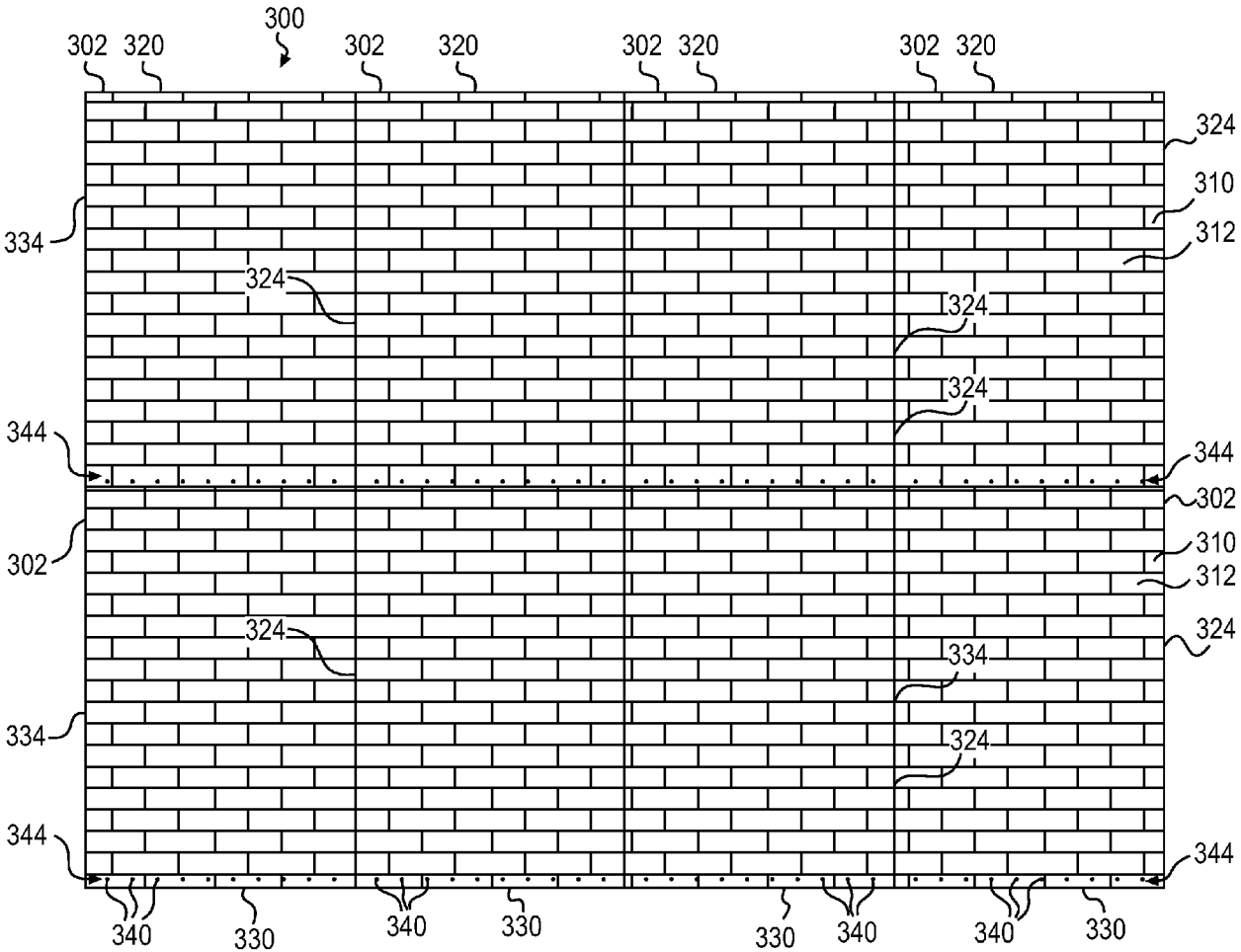
FIG. 17 is a front elevation view of the exterior wall panel system shown in FIG. 13A with a plurality of wall panels installed on a structure.

FIG. 17 shows the exterior wall panel system 300 comprising a plurality of panel bodies 202 installed on a structure. Each panel body 302 is installed with the front face 310 facing outward from the structure. The panel bodies 302 are aligned so that the first side edge 324 is aligned adjacent the second side edge 334 of the adjacent panel. Likewise, the bases 330 of some of the panel bodies 302 can be aligned adjacent the top edges 320 of the panel bodies installed directly below them. The panel bodies 302 within each row of panels are aligned so as to form a row of openings 340 extending across multiple panels. The panel bodies 302 can be affixed in place on the structure and then an air/water barrier calking can be applied to the seams formed between the panel bodies 302. In this way, the exterior wall panel system 300 including a plurality of panel bodies 302 can be arranged to form a continuous exterior surface of a building or other structure. As so installed, the exterior wall panel system 300 allows for water that penetrates the interior of the wall structure to be channeled out of the wall through the openings 340 formed in the exterior layers of each panel body 302.

Figure 18:
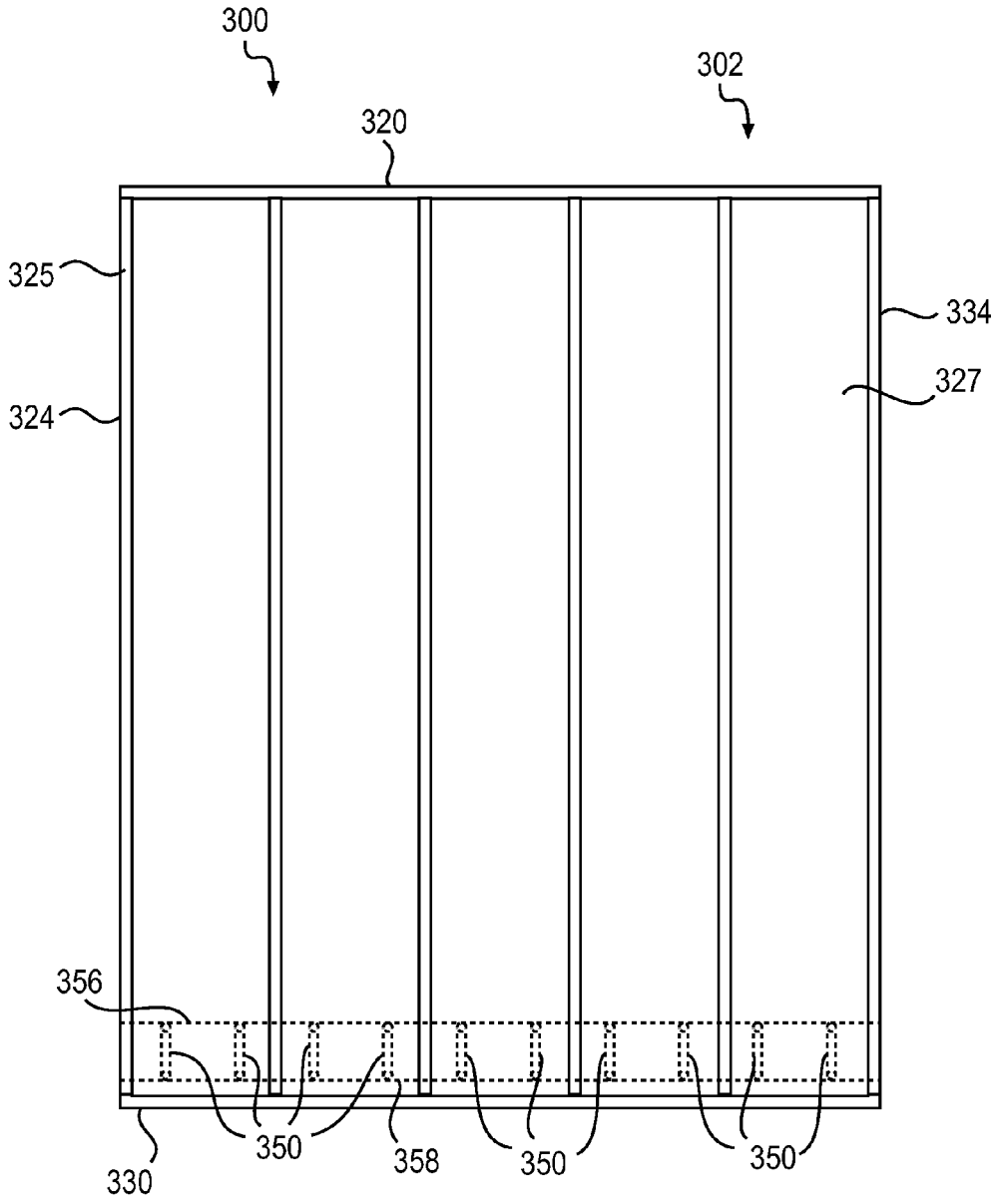
FIG. 18 is a rear elevation view of the exterior wall panel system shown in FIG. 13A with a portion of the inner structure shown in phantom line.

FIG. 18 shows the rear portion 327 of the panel body 302 of the exterior wall panel system 300 of the present disclosure. The frame 325 is aligned generally along the rear portion 327 of the panel body 302. The frame 325 includes a top beam, two side beams, a base beam, and intermediate vertical beams to provide support and reinforcement for the panel body 302. The side beams and the vertical beans extend from the base 330 to the top edge 320. The alignment of the channels 350 and the trough 338 are shown in phantom line.

The panel bodies of the exterior wall panel systems of the present disclosure can be of various heights, widths, and configurations. For example, while the panel bodies 102, 202, and 302 shown in the Figures are generally rectangular in shape with a height greater than the width of each panel body, the panel bodies encompassed by the present disclosure can be square, rectangular with a width greater than the height of the body, as well as include building features, such as window cutouts, door cutouts, and non-rectangular sides.

EXAMPLES

Testing was performed to evaluate two embodiments of drainage features for wall panel systems. The first embodiment of an exterior wall panel system to be tested included a wall panel having a trough formed in the back face of an expanded polystyrene (EPS) insulation panel. Sloped drainage channels were drilled from the trough to the exterior of the front face of the insulation panel. The inner surface of the trough was coated with a latex air barrier/waterproofing agent, Sto Gold Coat. The Sto Gold Coat was added in order to reduce the possibility of water absorption into the expanded polystyrene. The inner surfaces of the drainage channels also were coated with Sto Gold Coat to form a water barrier on the inner surface of the drainage channels. The expanded polystyrene layer was installed in a wall panel system using a standard notched trowel procedure with a continuous adhesive ribbon applied horizontally beneath the trough.

The second embodiment of an exterior wall panel system included an EPS wedge disposed at the base of a wall panel. The wedge was encased in a water barrier membrane. Weep tubes were aligned on the top sloped surface of the wedge and adhered to the wedge with urethane spray foam adhesive. Insulation board was then applied using a standard notched trowel method above the notch. The bottom edge of the insulation layer was beveled to match the slope of the wedge and was installed in a wall panel system. Plastic straws were used as drain tubes.

The panels constructed for each embodiment measured approximately 0.9 m in width and 1.2 m in height. An EPS wedge of approximately 5 cm in width was used. Test Method ASTM E2273, Standard Method for Drainage Efficiency of EIFS, was used as a guide for the testing program, though various aspects of the method were modified or not used. The water spray guidelines of ASTM E2273 were used to calculate the approximate total amount of water that would be introduced to the specimens during a standard test. The amount of water introduced was approximately 8000 g. A gravity-fed manifold with drip lines was configured to generate similar volume of water at a similar rate as set forth in the ASTM method.

Water in the amount of 8000 g was fed to a reservoir aligned above each panel. Water was then allowed to flow from the reservoir over the panel during a one hour time period. Water exiting the weep holes was collected and measured after 75 minutes and compared to the initial amount of water to determine the drainage efficiency of the panel drainage systems. The time period from the start of the water flow to the first appearance of water from the weep holes was measured.

For the first embodiment of the wall panel drainage system, the time period was 20 seconds and the drainage efficiency was 98.6%. For the second embodiment, the time period was 12 seconds and the drainage efficiency was 99%. The results lead to the conclusion that the two embodiments encompassed viable drainage systems for wall panel systems.

The embodiments set forth herein are provided to illustrate, not limit, the scope of the present disclosure. Alternative combinations and modifications of the features disclosed herein are contemplated by the present disclosure. Alternatives, variations, and modifications of the embodiments described herein will be apparent to one of ordinary skill in the art are encompassed by the present disclosure

What is claimed is:

1. An exterior wall panel system comprising:

a prefabricated panel body comprising a frame, a front face, a base, a top edge, a first side edge extending between the base and the top edge, and a second side edge extending between the base and the top edge, an exterior layer disposed at the front face of the panel body, an insulation layer disposed between the frame and the exterior layer, a wedge disposed between the insulation layer and the base, wherein the wedge includes a sloped surface, a first edge wrap disposed between the insulation layer and the first side edge of the panel body, a second edge wrap disposed between the insulation layer and the second side edge of the panel body, a channel formed in the panel body, wherein a portion of the channel is aligned along the sloped surface of the wedge, and an opening formed in the exterior layer and open to the front face of the panel body, wherein the channel is in fluid communication with the opening.

2. The exterior wall panel system of claim 1, further comprising a tube disposed in a portion of the channel.

3. The exterior wall panel system of claim 1, wherein at least one of the first and the second edge wraps comprise a water barrier layer.

4. The exterior wall panel system of claim 1, wherein the insulation layer comprises a bevel surface facing the sloped surface of the wedge.

5. The exterior wall panel system of claim 1, wherein the channel comprises an interior surface having a water barrier layer formed thereon.

6. The exterior wall panel system of claim 1, where the insulation layer comprises a rear face having a water barrier layer formed thereon.

7. The exterior wall panel system of claim 1, wherein the wedge has a water barrier layer formed thereon.

8. The exterior wall panel system of claim 1, further comprising a sheathing layer disposed between the frame and the insulation layer.

9. The exterior wall panel system of claim 8, further comprising an adhesive ribbon disposed between the insulation layer and the sheathing layer.

10. The exterior wall panel system of claim 1, wherein in the channel is one of a plurality of channels formed in the panel body and in fluid communication with the front face of the panel body.

11. The exterior wall panel system of claim 1, wherein the exterior layer comprises a stucco finish.

12. The exterior wall panel system of claim 1, wherein the exterior layer comprises a brick finish.

13. An exterior wall panel system comprising:

a panel body comprising a frame, a front face, a base, a top edge, a first side edge extending between the base and the top edge, and a second side edge extending between the base and the top edge, an exterior layer disposed at the front face of the panel body, an insulation layer disposed between the frame and the exterior layer, a wedge disposed between the insulation layer and the base, wherein the wedge includes a sloped surface, a first edge wrap disposed between the insulation layer and the first side edge of the panel body, a second edge wrap disposed between the insulation layer and the second side edge of the panel body, a channel formed in the panel body, wherein a portion of the channel is aligned along the sloped surface of the wedge, and an opening formed in the exterior layer and open to the front face of the panel body, wherein the channel is in fluid communication with the opening, and foam disposed between the insulation layer and the wedge.

14. An exterior wall panel system comprising:

a panel body comprising a frame, a front face, a base, a top edge, a first side edge extending between the base and the top edge, and a second side edge extending between the base and the top edge, an exterior layer disposed at the front face of the panel body, an insulation layer disposed between the frame and the exterior layer, a wedge disposed between the insulation layer and the base, wherein the wedge includes a sloped surface, a first edge wrap disposed between the insulation layer and the first side edge of the panel body, a second edge wrap disposed between the insulation layer and the second side edge of the panel body, a channel formed in the panel body, wherein a portion of the channel is aligned along the sloped surface of the wedge, and an opening formed in the exterior layer and open to the front face of the panel body, wherein the channel is in fluid communication with the opening, and wherein the insulation layer further comprises a trough formed therein and wherein the trough is in fluid communication with the channel.

15. The exterior wall panel system of claim 14, wherein the trough has a water barrier layer formed thereon.

16. An exterior wall panel system comprising:

a prefabricated panel body comprising a frame, a front face, a base, a top edge, a first side edge extending between the base and the top edge, and a second side edge extending between the base and the top surface, an exterior layer disposed at the front face of the panel body, an insulation layer disposed between the frame and the exterior layer, wherein the insulation layer comprises a rear face, a first edge wrap disposed between the insulation layer and the first side edge of the panel body, a second edge wrap disposed between the insulation layer and the second side edge of the panel body, a sloped surface disposed in the panel body, a channel formed in the panel body, wherein a portion of the channel is aligned on the sloped surface, and wherein the channel is in fluid communication with the front face of the panel body and the rear face of the insulation layer.

17. The exterior wall panel system of claim 16, further comprising a tube disposed in a portion of the channel.

18. The exterior wall panel system of claim 16, wherein the insulation layer comprises a bevel surface facing the sloped surface formed in the panel body.

19. The exterior wall panel system of claim 16, wherein the channel comprises an interior surface having a water barrier layer formed thereon.

20. The exterior wall panel system of claim 16, further comprising spray urethane foam disposed on the sloped surface.

21. The exterior wall panel system of claim 16, wherein the rear face of the insulation layer has a water barrier layer formed thereon.

22. The exterior wall panel system of claim 16, wherein the sloped surface has a water barrier layer formed thereon.

23. The exterior wall panel system of claim 16, further comprising a furring disposed between the frame and the insulation layer.

24. The exterior wall panel system of claim 16, further comprising an adhesive ribbon disposed between the insulation layer and the frame.

25. The exterior wall panel system of claim 16, wherein in the channel is one of a plurality of channels formed in the panel body and in fluid communication with the front face of the panel body.

26. The exterior wall panel system of claim 16, wherein the exterior layer comprises a stucco finish.

27. The exterior wall panel system of claim 16, wherein the exterior layer comprises a brick finish.

28. An exterior wall panel system comprising:

a panel body comprising a frame, a front face, a base, a top edge, a first side edge extending between the base and the top edge, and a second side edge extending between the base and the top surface, an exterior layer disposed at the front face of the panel body, an insulation layer disposed between the frame and the exterior layer, wherein the insulation layer comprises a rear face, a first edge wrap disposed between the insulation layer and the first side edge of the panel body, a second edge wrap disposed between the insulation layer and the second side edge of the panel body, a sloped surface disposed in the panel body, a channel formed in the panel body, wherein a portion of the channel is aligned on the sloped surface, and wherein the channel is in fluid communication with the front face of the panel body and the rear face of the insulation layer, and wherein the insulation layer further comprises a trough formed therein and wherein the trough is in fluid communication with the channel.

29. The exterior wall panel system of claim 28, wherein the trough has a water barrier layer formed thereon.

30. An exterior wall panel system comprising:

a panel body comprising a frame, a front face, a base, a top edge, a first side edge extending between the base and the top edge, and a second side edge extending between the base and the top surface, an exterior layer disposed at the front face of the panel body, an insulation layer disposed between the frame and the exterior layer, wherein the insulation layer comprises a rear face, a wedge disposed between the base of the panel body and the insulation layer, wherein the wedge comprises a sloped surface and a water barrier formed thereon, a plurality of channels formed in the panel body, wherein the plurality of channels are aligned on the sloped surface of the wedge, and wherein the plurality of channels are in fluid communication with the front face of the panel body and the rear face of the insulation layer, and a trough formed in the insulation layer, wherein the trough is in fluid communication with the plurality of channels.

* * * * *